US011348753B2

(12) United States Patent
Inaguchi et al.

(10) Patent No.: US 11,348,753 B2
(45) Date of Patent: May 31, 2022

(54) CONTACTOR HAVING FIXED AND MOVABLE IRON CORES AND A MOVABLE CONTACT

(71) Applicant: Mitsubishi Electric Corporation, Tokyo (JP)

(72) Inventors: Takashi Inaguchi, Tokyo (JP); Kazuki Takahashi, Tokyo (JP); Katsuki Hotta, Tokyo (JP); Hiroyuki Nozaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 135 days.

(21) Appl. No.: 16/649,992

(22) PCT Filed: Dec. 1, 2017

(86) PCT No.: PCT/JP2017/043329
§ 371 (c)(1),
(2) Date: Mar. 24, 2020

(87) PCT Pub. No.: WO2019/106836
PCT Pub. Date: Jun. 6, 2019

(65) Prior Publication Data

US 2020/0219691 A1 Jul. 9, 2020

(51) Int. Cl.
*H01H 71/24* (2006.01)

(52) U.S. Cl.
CPC .... *H01H 71/2454* (2013.01); *H01H 71/2472* (2013.01); *H01H 2071/249* (2013.01)

(58) Field of Classification Search
CPC ..... H01H 71/2454; H01H 71/2472; H01H 71/2409; H01H 2071/249; H01H 73/045; H01H 89/08
(Continued)

(56) References Cited

U.S. PATENT DOCUMENTS 3,873,952 A * 3/1975 Kondo ..... H01H 50/22 335/192
4,409,575 A * 10/1983 Hisadome ..... H01H 51/005 200/50.33
(Continued)

FOREIGN PATENT DOCUMENTS

JP 58-169746 A 10/1983
JP 04-51420 A 2/1992
(Continued)

OTHER PUBLICATIONS

International Search Report and Written Opinion dated Feb. 6, 2018 for PCT/JP2017/043329 filed on Dec. 1, 2017, 8 pages including English Translation of the International Search Report.

*Primary Examiner* — Scott Bauer
*Assistant Examiner* — Sreeya Sreevatsa
(74) *Attorney, Agent, or Firm* — Xsensus LLP

(57) ABSTRACT

A contactor includes a fixed iron core, a movable iron core, an operation coil, a first crossbar, a tripping spring, and a second crossbar. The contactor includes a push spring to push a movable contact toward a fixed contact, a trip coil connected to the fixed contact, and a plunger that is operated by an electromagnetic force generated in the trip coil when a current of a predetermined value or higher flows through the trip coil. The contactor includes an opening lever to push the second crossbar in a direction away from the first crossbar in conjunction with the operation of the plunger.

14 Claims, 10 Drawing Sheets

(58) Field of Classification Search
USPC ..... 335/15
See application file for complete search history.

(56) References Cited

U.S. PATENT DOCUMENTS

| | | | | | |
|---|---|---|---|---|---|
| 4,477,704 | A | * | 10/1984 | Mori | H01H 9/46 218/148 |
| 4,975,665 | A | * | 12/1990 | Ohishi | H01H 89/08 335/14 |
| 5,163,175 | A | * | 11/1992 | Mori | H01H 89/08 335/132 |
| 5,252,933 | A | | 10/1993 | Kamino et al. | |
| 2007/0236841 | A1 | * | 10/2007 | Asano | H01H 71/0228 361/42 |

FOREIGN PATENT DOCUMENTS

| | | | | |
|---|---|---|---|---|
| JP | 04-75227 | A | | 3/1992 |
| JP | 2009049231 | A | * | 3/2009 |

* cited by examiner

| STATE OF HANDLE | OFF | READY | | TRIP |
|---|---|---|---|---|
| CONTACT POINT STATE | OPEN | OPEN | CLOSED | OPEN |

CONTACTOR HAVING FIXED AND MOVABLE IRON CORES AND A MOVABLE CONTACT

CROSS-REFERENCE TO RELATED APPLICATIONS

The present application is based on PCT filing PCT/JP2017/043329, filed Dec. 1, 2017, the entire contents of which are incorporated herein by reference.

FIELD

The present invention relates to a contactor including a movable contact and a fixed contact and having a function of opening contact points when an overcurrent occurs.

BACKGROUND

The circuit breaker disclosed in Patent Literature 1 includes a first electromagnet for automatically opening contact points when an overcurrent occurs, a second electromagnet for performing remote opening/closing operation, and an electromagnet actuating lever that converts a horizontal linear motion of the movable iron core of the second electromagnet into a rotary motion. An overcurrent is a current that exceeds the rated current value allowed by the circuit breaker. Contact points mean both a contact point provided on the movable contact which is a movable electrode and a contact point provided on the fixed contact which is a fixed electrode facing the movable contact. Remote opening/closing operation means closing the contact points by applying current output from an external power supply to the second electromagnet and opening the contact points by cutting off the supply of current from the external power supply to the second electromagnet. Closing refers to bringing the contact point provided on the movable contact into contact with the contact point provided on the fixed contact. Opening refers to moving the contact point provided on the movable contact away from the contact point provided on the fixed contact. The circuit breaker disclosed in Patent Literature 1 also includes a crossbar provided at the end of the electromagnet actuating lever, an opening/closing operation lever that moves in the vertical direction with its end in contact with the crossbar, and a contact point provided on the opening/closing operation lever.

In addition to the movable iron core, the second electromagnet includes a fixed iron core, an exciting coil, and an attraction release spring. The attraction release spring is provided between the fixed iron core and the movable iron core. The attraction release spring is a spring that stores energy in a compressed state. Here, when the exciting coil is excited in remote opening/closing operation, the movable iron core moves close to the fixed iron core against the restoring force of the attraction release spring. At this time, the attraction release spring is compressed and pushes the movable iron core in a direction away from the fixed iron core. When the excitation of the exciting coil is stopped in this state, the movable iron core moves in the horizontal direction away from the fixed iron core due to the restoring force of the attraction release spring. As the movable iron core moves in the horizontal direction, the electromagnet actuating lever rotates clockwise around the shaft, and the crossbar provided on the electromagnet actuating lever also rotates clockwise. As the crossbar rotates clockwise and pushes the tip of the opening/closing operation lever, the opening/closing operation lever moves in the vertical direction, and the movable contact provided at the lower end of the opening/closing operation lever moves away from the fixed contact.

CITATION LIST

Patent Literature

Patent Literature 1: Japanese Patent Application Laid-open No. H4-75227

SUMMARY

Technical Problem

However, in the circuit breaker disclosed in Patent Literature 1, since the crossbar performs rotary movement, the tip of the opening/closing operation lever in contact with the crossbar moves in the horizontal direction, and the opening/closing operation lever is tilted at a certain angle with respect to the vertical direction. Therefore, the movable contact provided at the lower end of the opening/closing operation lever is tilted at a certain angle with respect to the horizontal direction, resulting in a difference between the timing at which the first movable contact point provided on the movable contact and the first fixed contact point provided on the fixed contact are opened or closed and the timing at which the second movable contact point provided on the movable contact and the second fixed contact point provided on the fixed contact are opened or closed. For example, the opening timing of the first movable contact point and the first fixed contact point is earlier than the opening timing of the second movable contact point and the second fixed contact point. Therefore, at the time of opening, an arc is generated between the first movable contact point and the first fixed contact point, and then the second movable contact point and the second fixed contact point are opened to interrupt the current. Thus, the period of time in which an arc is generated between the first movable contact point and the first fixed contact point is longer than the period of time in which an arc is generated between the second movable contact point and the second fixed contact point. On the other hand, at the time of closing, the second movable contact point and the second fixed contact point are closed earlier than the first movable contact point and the first fixed contact point. No current flows at the time that the second movable contact point and the second fixed contact point are closed, and a current flows at the time that the first movable contact point and the first fixed contact point are closed, whereby an arc is generated between the first movable contact point and the first fixed contact point. Therefore, the first movable contact point and the first fixed contact point are exposed to arcs for a longer time and thus experience more rapid progress of wear than the second movable contact point and the second fixed contact point. In addition, as the contact points are worn, the difference between the opening/closing timing of the first movable contact point and the first fixed contact point and the opening/closing timing of the second movable contact point and the second fixed contact point increases, which accelerates the progress of wear on the first movable contact point and the first fixed contact point and may shorten the life for opening/closing.

The present invention has been made in view of the above, and an object thereof is to obtain a contactor capable of opening the contact points when an overcurrent occurs while restraining the progress of wear on the contact points during remote opening/closing operation.

Solution to Problem

In order to solve the above-described problems and achieve the object, a contactor according to an aspect of the present invention includes a movable contact including a movable contact point and a fixed contact including a fixed contact point facing the movable contact point, and the contactor includes: a fixed iron core; a movable iron core, one end of the movable iron core facing the fixed iron core; and an operation coil provided around the movable iron core, the operation coil being configured to generate, by a current supplied from an outside of the contactor, an electromagnetic force that brings the movable iron core into contact with the fixed iron core. The contactor includes: a first movable bar having an insulating property, one end of the first movable bar being fixed to another end of the movable iron core; a tripping spring that pushes the first movable bar in a direction away from the fixed iron core; and a second movable bar, one end of the second movable bar facing another end of the first movable bar, another end of the second movable bar holding the movable contact, the second movable bar being configured to move in a direction same as a moving direction of the first movable bar. The contactor includes: a push spring that pushes the movable contact toward the fixed contact; a trip coil connected to the fixed contact; and a plunger that is operated by an electromagnetic force generated in the trip coil when a current of a predetermined value or higher flows through the trip coil. The contactor includes an opening lever that pushes the second movable bar in a direction away from the first movable bar in conjunction with an operation of the plunger.

Advantageous Effects of Invention

The present invention can achieve the effect of opening the contact points when an overcurrent occurs while restraining the progress of wear on the contact points during remote opening/closing operation.

DESCRIPTION OF EMBODIMENTS

Hereinafter, a contactor according to embodiments of the present invention will be described in detail based on the drawings. The present invention is not limited to the embodiments.

Embodiment

Figure 1:
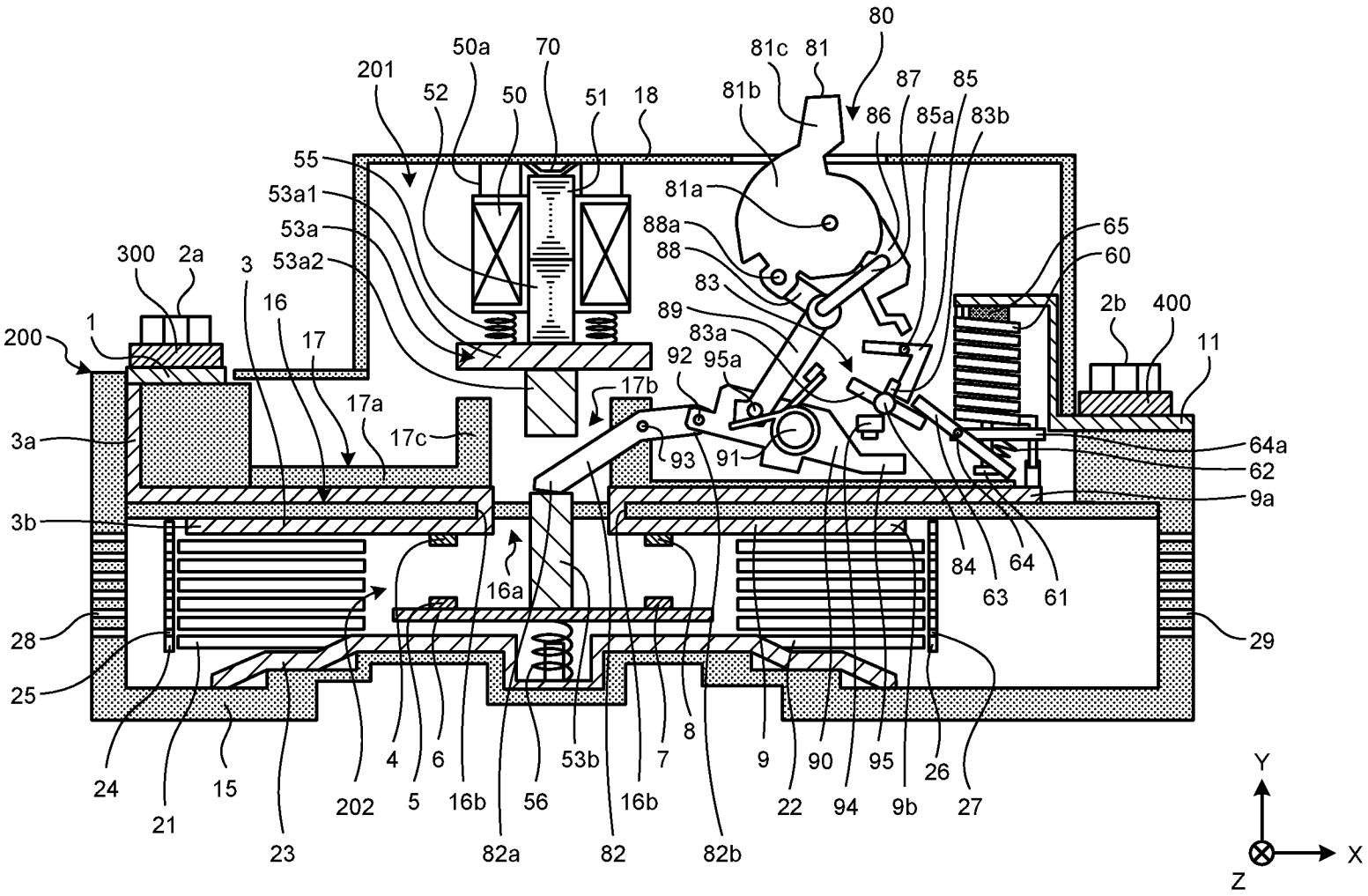
FIG. 1 is a cross-sectional view of a contactor according to an embodiment of the present invention.
Figures 2, 3:
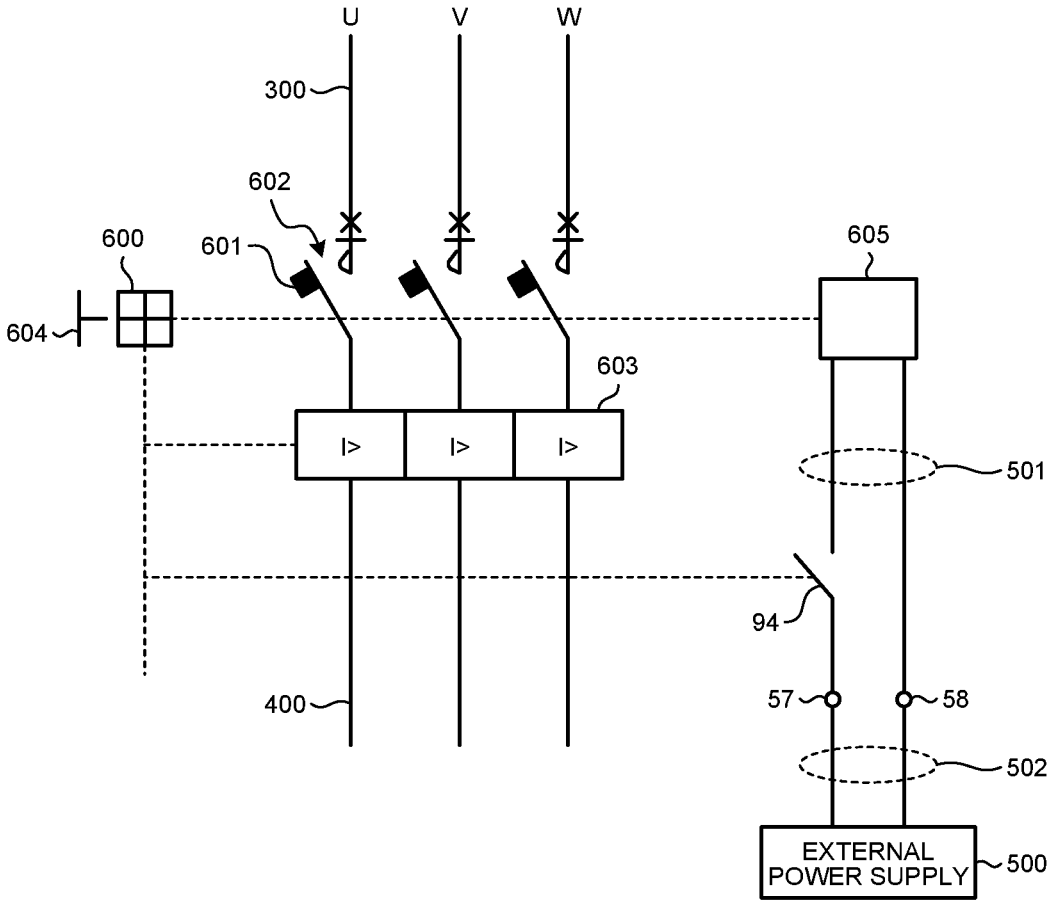
FIG. 2 is a circuit diagram that depicts the contactor illustrated in FIG. 1 using JIS symbols.
FIG. 3 is a diagram illustrating the states of the handle illustrated in FIG. 1 and contact point states.

FIG. 1 is a cross-sectional view of a contactor according to an embodiment of the present invention. FIG. 2 is a circuit diagram that depicts the contactor illustrated in FIG. 1 using Japanese Industrial Standards (JIS) symbols. A contactor 100 according to the embodiment is, for example, a contactor that opens and closes an electric circuit such as a distribution line. As illustrated in FIG. 1, the contactor 100 includes a housing 200, a second crossbar 53*b*, a first crossbar 53*a*, a power-side fixed contact 3, a power-side terminal 1, a power-side fixed contact point 4, a power-side grid fixer 24, and a power-side grid 21. The contactor 100 also includes a load-side fixed contact 9, a trip coil 60, a load-side terminal 11, a load-side fixed contact point 8, a load-side grid fixer 26, and a load-side grid 22. Hereinafter, the power-side fixed contact point 4 and the load-side fixed contact point 8 may be simply referred to as "fixed contact points". The following description is based on a left-handed XYZ coordinate system, in which the horizontal direction of the housing 200 is defined as the X-axis direction, the vertical direction of the housing 200 is defined as the Y-axis direction, and the depth direction of the housing 200 orthogonal to both the X-axis direction and the Y-axis direction is defined as the Z-axis direction. In addition, the positive Y-axis direction is defined as the upward direction, the negative Y-axis direction is defined as the downward direction, the positive X-axis direction is defined as the right direction, and the negative X-axis direction is defined as the left direction.

The housing 200 includes an upper case 18 and a lower case 15 provided below the upper case 18. The lower case 15 is a housing with a bottom, and the lower case 15 includes a partition plate 16 and a partition plate 17. The partition plate 17 is provided above the partition plate 16. By providing the partition plate 16 and the partition plate 17, a space 201 in the upper case 18 and a space 202 in the lower case 15 are formed inside the housing 200. The partition plate 16 and the partition plate 17 are insulating members for preventing an arc generated in the space 202 at the time of opening from being transmitted to a mechanism provided in the space 201, and preventing high temperature air in the space 202 heated by the arc from being transmitted to a mechanism provided in the space 201. Examples of the material of the upper case 18, the lower case 15, the partition plate 16, and the partition plate 17 can include insulating resins such as nylon 66, nylon 6, nylon, and phenolic resin.

At a plate surface 17*a* of the partition plate 17, a through hole 17*b* is formed and a protrusion 17*c* is provided. The protrusion 17*c* may be formed of an annular member surrounding the entire periphery of the through hole 17*b*, or may be formed of a plurality of columnar members provided apart from each other around the through hole 17*b*. The protrusion 17*c* is a member for stopping the first crossbar 53*a*, which is a first movable bar moving downward to approach the second crossbar 53*b*, which is a second movable bar, at a specific position. Details of the configurations of the second crossbar 53*b* and the first crossbar 53*a* will be described later. The protrusion 17*c* is a protruding member extending upward from the plate surface 17*a*. The plate surface 17*a* and the protrusion 17*c* may be manufactured through integral molding by die casting using an insulating resin, or may be combined with each other after being manufactured individually.

A through hole 16*a* is formed in the partition plate 16. The through hole 16*a* communicates with the through hole 17*b* of the partition plate 17.

The power-side fixed contact 3 is provided across the upper surface of the partition plate 16 on the left side of the through hole 16*a*, an open wall surface 16*b* formed on the partition plate 16, and the lower surface of the partition plate 16 on the left side of the through hole 16*a*. One end 3*a* of the power-side fixed contact 3 is connected to the power-side terminal 1. A through hole through which a screw 2*a* passes is formed in the power-side terminal 1 and a power-side outer conductor 300 provided outside the housing 200. When the tip of the screw 2*a* inserted into the through hole is screwed into the lower case 15, the power-side outer conductor 300 and the power-side terminal 1 come into contact with each other. Consequently, the power-side fixed contact 3 is electrically connected to the power-side outer conductor 300. Examples of the material of the power-side terminal 1 can include iron and copper having conductivity. Examples of the power-side outer conductor 300 can include an insulation-coated wiring conductor, a rod-shaped bus bar, and the like.

The other end 3*b* of the power-side fixed contact 3 is provided on the lower surface of the partition plate 16. The power-side fixed contact 3 includes the power-side fixed contact point 4. The power-side fixed contact point 4 is provided between the other end 3*b* of the power-side fixed contact 3 and the through hole 16*a*.

The power-side grid 21 is a member for extinguishing an arc. A plurality of power-side grids 21 are arranged away from each other from the lower surface of the power-side fixed contact 3 toward the bottom wall of the lower case 15 on the left side of the movable contact point and the fixed contact point. The power-side grid fixer 24 is a member for fixing the power-side grid 21. A plurality of power-side grid fixer windows 25 are formed on the power-side grid fixer 24. The power-side grid fixer window 25 is a through hole for allowing high temperature air in the lower case 15 to pass therethrough. The plurality of power-side grid fixer windows 25 are arranged apart from each other in the vertical direction. The power-side grid fixer 24 can be exemplified by insulating fiber paper. Examples of the material of the power-side grid 21 can include magnetic materials such as iron.

A plurality of lower case power-side windows 28 are formed on the left side wall of the lower case 15 at locations facing the left end face of the power-side grid fixer 24. The lower case power-side window 28 is a through hole communicating with the outside of the left side wall of the lower case 15 and with the space 202 in order to discharge high temperature air out of the lower case 15. The plurality of lower case power-side windows 28 are arranged away from each other in the vertical direction on the left side wall of the lower case 15.

The load-side fixed contact 9 is provided across the upper surface of the partition plate 16 on the right side of the through hole 16*a*, the open wall surface 16*b* formed on the partition plate 16, and the lower surface of the partition plate 16 on the right side of the through hole 16*a*. One end 9*a* of the load-side fixed contact 9 is connected to one end of the trip coil 60. The trip coil 60 is provided on an insulating fixing member 64*a*. An insulating pipe 65 is provided inside the trip coil 60. Inside the insulating pipe 65, a plunger 61 is provided. The plunger 61 is a columnar magnetic material, such as iron, that moves in the vertical direction with its outer peripheral surface in contact with the inside of the insulating pipe 65 due to the electromagnetic force generated in the trip coil 60 when a current of a predetermined value or higher flows through the trip coil 60. The predetermined value is, for example, 10 to 20 times as large as the value of a current that flows through the trip coil 60 when no overcurrent occurs, but the predetermined value may be optimally set depending on the application of the contactor 100. The cross-sectional area of the lower end of the plunger 61 is larger than the cross-sectional area of the portion between the lower end and the upper end of the plunger 61, and thus the lower end of the plunger 61 forms a head. One end of a link rod 63 is bifurcated and sandwiches the head of the plunger 61. Details of the configuration of the link rod 63 will be described later. The other end of the trip coil 60 is connected to one end of the load-side terminal 11 constituting the magnetic circuit of the trip coil 60. A through hole through which a screw 2*b* passes is formed in the other end of the load-side terminal 11 and a load-side outer conductor 400. When the tip of the screw 2*b* inserted into the through hole is screwed into the lower case 15, the load-side outer conductor 400 and the load-side terminal 11 come into contact with each other, and the load-side fixed contact 9 is electrically connected to the load-side outer conductor 400. Examples of the material of the load-side terminal 11 can include magnetic materials such as iron having conductivity. Examples of the load-side outer conductor 400 can include an insulation-coated wiring conductor, a rod-shaped bus bar, and the like.

The other end 9*b* of the load-side fixed contact 9 is provided on the lower surface of the partition plate 16. The load-side fixed contact 9 includes the load-side fixed contact point 8. The load-side fixed contact point 8 is provided between the other end 9*b* of the load-side fixed contact 9 and the through hole 16*a*.

The load-side grid 22 is a member for extinguishing an arc. A plurality of load-side grids 22 are arranged away from each other from the lower surface of the load-side fixed contact 9 toward the bottom wall of the lower case 15 on the right side of the movable contact point and the fixed contact point. The load-side grid fixer 26 is a member for fixing the load-side grid 22. A plurality of load-side fixer windows 27 are formed on the load-side grid fixer 26. The load-side fixer window 27 is a through hole for allowing high temperature air in the lower case 15 to pass therethrough. The plurality of load-side fixer windows 27 are arranged apart from each other in the vertical direction. The load-side grid fixer 26 can be exemplified by insulating fiber paper. Examples of the material of the load-side grid 22 can include magnetic materials such as iron.

A plurality of lower case load-side windows 29 are formed on the right side wall of the lower case 15 at locations facing the right end face of the load-side grid fixer 26. The lower case load-side window 29 is a through hole communicating with the outside of the right side wall of the lower case 15 and with the space 202 in order to discharge high temperature air out of the lower case 15. The plurality of lower case load-side windows 29 are arranged apart from each other in the vertical direction on a side wall of the lower case 15.

The contactor 100 includes an arc runner 23, a movable contact 6, the second crossbar 53*b*, a power-side movable contact point 5, a load-side movable contact point 7, and a push spring 56. Hereinafter, the power-side movable contact point 5 and the load-side movable contact point 7 may be simply referred to as "movable contact points". The arc runner 23, the movable contact 6, the second crossbar 53*b*, the power-side movable contact point 5, the load-side movable contact point 7, and the push spring 56 are provided in the space 202 of the lower case 15.

The arc runner 23 is a member on which an arc generated at the time of opening travels away from the contact points, and faces the second crossbar 53*b* across the movable contact 6. Traveling means that an arc generated between the power-side fixed contact point 4 and the power-side movable contact point 5 moves between the power-side fixed contact point 4 and the power-side movable contact point 5, between the power-side fixed contact 3 and the arc runner 23, and to the power-side grid 21, in this order. Similarly, traveling means that an arc generated between the load-side fixed contact point 8 and the load-side movable contact point 7 moves between the load-side fixed contact point 8 and the load-side movable contact point 7, between the load-side fixed contact 9 and the arc runner 23, and to the load-side grid 22, in this order. The reason why an arc moves in this way is that the current circuit formed by the power-side fixed contact 3, the load-side fixed contact 9, the movable contact 6, and the arc exerts the Lorentz force, i.e. electromagnetic force that pushes the arc toward the power-side grid 21 or the load-side grid 22. Since the power-side grid 21 and the load-side grid 22 are formed of magnetic materials, the power-side grid 21 and the load-side grid 22 have an effect of attracting an arc. The arc runner 23 is fixed to the upper side of the bottom wall of the lower case 15. Examples of the material of the arc runner 23 can include iron and copper having conductivity. The arc runner 23 may be manufactured by die casting using the above material, or may be manufactured from a plate member by press forming.

The movable contact 6 is a conductive plate-like member extending in the horizontal direction, and is provided above the arc runner 23. Examples of the material of the movable contact 6 can include conductors such as copper alloys and iron alloys. On the upper surface of the movable contact 6, the second crossbar 53*b*, the power-side movable contact point 5, and the load-side movable contact point 7 are provided. Examples of the material of the second crossbar 53*b* can include insulating resins such as phenolic resin, acrylonitrile butadiene styrene (ABS) resin, and nylon resin. The upper end of the second crossbar 53*b* faces the lower end of a projection 53*a*2 of the first crossbar 53*a* and faces one end 82*a* of an opening lever 82. The lower end of the second crossbar 53*b* is fixed to the movable contact 6. That is, one end of the second crossbar 53*b* faces the other end of the first crossbar 53*a*, and the other end of the second crossbar 53*b* holds the movable contact 6. The second crossbar 53*b* moves in the direction same as the moving direction of the first crossbar 53*a*. The moving direction is the vertical direction.

The power-side movable contact point 5 faces the power-side fixed contact point 4 and is fixed to the movable contact 6 by brazing, swaging, or the like. The load-side movable contact point 7 faces the load-side fixed contact point 8 and is fixed to the movable contact 6 by brazing, swaging, or the like. Examples of the material of the power-side movable contact point 5 and the load-side movable contact point 7 can include conductors such as silver alloys. The movable contact 6, the power-side movable contact point 5, and the load-side movable contact point 7 are electrically connected to one another.

The push spring 56 is provided below the movable contact 6. The push spring 56 is used to push the movable contact 6 toward the power-side fixed contact point 4 and the load-side fixed contact point 8. The push spring 56 is a spring that stores energy in a compressed state and expands and contracts in the vertical direction. The upper end of the push spring 56 is fixed to the movable contact 6, and the lower end of the push spring 56 is in contact with the lower case 15.

The contactor 100 includes the first crossbar 53*a*, a movable iron core 52, a fixed iron core 51, an operation coil 50, and a tripping spring 55. The first crossbar 53*a*, the movable iron core 52, the fixed iron core 51, the operation coil 50, and the tripping spring 55 are provided in the space 201 of the upper case 18.

The first crossbar 53*a* is an insulating member including a plate 53*a*1 and the projection 53*a*2 and having an X-Y cross section of a T shape. The shapes of the plate 53*a*1 and the projection 53*a*2 will be described later. Examples of the material of the first crossbar 53*a* can include the materials listed as examples of the material of the second crossbar 53*b*. The plate 53*a*1 and the projection 53*a*2 may be integrally manufactured using the above material, or may be combined with each other after being manufactured individually.

The projection 53*a*2 is a columnar member extending from the lower end of the plate 53*a*1 toward the second crossbar 53*b*. The upper end of the projection 53*a*2 is fixed to the middle portion of the lower end of the plate 53*a*1 in the X-axis direction. The lower end of the projection 53*a*2 faces the upper end of the second crossbar 53*b* across the through hole 17*b* and the through hole 16*a*. A portion of the lower end of the plate 53*a*1 closer to the end than the middle portion in the X-axis direction faces the upper end of the protrusion 17*c* of the partition plate 17.

The movable iron core 52 is provided at the middle portion of the upper end of the plate 53*a*1 in the X-axis direction. The movable iron core 52 is a member formed by stacking a plurality of silicon steel plates. The fixed iron core 51 is provided above the upper end of the movable iron core 52. That is, one end of the movable iron core 52 faces the lower end of the fixed iron core 51. The fixed iron core 51 is a member formed by stacking a plurality of silicon steel plates. In FIG. 1, the lower end of the fixed iron core 51 is in contact with the upper end of the movable iron core 52. An iron core holding member 70 is provided above the upper end of the fixed iron core 51. The fixed iron core 51 is fixed to the upper wall of the upper case 18 via the iron core holding member 70. The lower end of the movable iron core 52 is fixed to the upper end of the plate 53*a*1. That is, the first crossbar 53*a* is fixed to the other end of the movable iron core 52.

The operation coil 50 is provided around the fixed iron core 51 and the movable iron core 52. As illustrated in FIG. 2, the operation coil 605 is connected to an external power supply 500 via a pair of wires 501, a pair of operation coil terminals 57 and 58, and a pair of wires 502. An operation coil switch 94 is provided between one of the pair of wires 501 and the operation coil terminal 57. The operation coil switch 94 is a switch for supplying current from the external power supply 500 to the operation coil 50 or stopping supply of current from the external power supply 500 to the operation coil 50. Details of the operation of the operation coil switch 94 will be described later. In FIG. 2, the graphic symbol denoted by reference sign 600 is a trip-free mechanism defined in JIS C 0617-7. Similarly, the graphic symbol denoted by reference sign 601 is an automatic tripping device. The graphic symbol denoted by reference sign 602 is a contactor contact point, and corresponds to the power-side fixed contact point 4, the load-side fixed contact point 8, the power-side movable contact point 5, and the load-side movable contact point 7 illustrated in FIG. 1. The graphic symbol denoted by reference sign 603 is an overcurrent tripping device. The graphic symbol denoted by reference sign 604 is a manual operation switch, and corresponds to a handle 81 illustrated in FIG. 1. The graphic symbol denoted by reference sign 605 is a coil for a remote tripping device, and corresponds to the operation coil 50 illustrated in FIG. 1. The manual operation switch 604 is connected to the trip-free mechanism 600. The trip-free mechanism 600 is connected to the contactor contact point 602, the overcurrent tripping device 603, and the operation coil switch 94. The operation coil 50 is connected to the contactor contact point 602. During interrupting operation, the manual operation switch 604, the contactor contact point 602, and the operation coil switch 94 are turned off by the trip-free mechanism 600. On the other hand, when a current supplied from the external power supply 500 flows to the coil 605 for the remote tripping device, the contactor contact point 602 is turned on, and when a current from the external power supply 500 is not supplied to the coil 605 for the remote tripping device, the contactor contact point 602 is turned off.

Returning to FIG. 1, the operation coil 50 is fixed to the upper wall of the upper case 18 via a fixing member 50*a*. The tripping spring 55 that expands and contracts in the vertical direction is provided between the lower end of the operation coil 50 and the upper end of the plate 53*a*1. The tripping spring 55 is used to push the first crossbar 53*a* and the movable iron core 52 in a direction away from the fixed iron core 51 when a current from the external power supply 500 is not supplied to the operation coil 50, that is, when no electromagnetic force is generated in the operation coil 50. The tripping spring 55 is a spring that stores energy in a compressed state and expands and contracts in the vertical direction. The restoring force of the tripping spring 55 is stronger than the restoring force of the push spring 56. The upper end of the tripping spring 55 is fixed to an insulating housing provided around the operation coil 50. The lower end of the tripping spring 55 is fixed to the upper end of the plate 53*a*1 at a location closer to the end than the middle portion in the X-axis direction.

The contactor 100 includes a manual control mechanism 80. The manual control mechanism 80 is provided in the space 201 of the upper case 18. The manual control mechanism 80 includes the handle 81, the opening lever 82, a magnetic bar 83, a latch 85, a lever 86, a U shaft 87, an upper link 88, and a lower link 89.

The handle 81 includes a pin 81*a*, a rotor 81*b* rotatably supported by the pin 81*a*, and an operating portion 81*c* provided on the rotor 81*b*. The operating portion 81*c* extends from the rotor 81*b* toward the upper side of the upper case 18, and protrudes out of the upper case 18 through an opening formed in the upper wall of the upper case 18. The distal end of the operating portion 81*c* is provided outside the upper case 18. The lever 86 is provided on the rotor 81*b*. The lever 86 is rotatably provided by the pin 81*a* provided on the rotor 81*b*. The lever 86 extends from the rotor 81*b* toward the latch 85.

The latch 85 is a member rotatably supported by a pin 85*a* and having an X-Y cross section of an L shape. One end of the latch 85 is provided near the lever 86, and the other end of the latch 85 is provided near the magnetic bar 83.

The magnetic bar 83 includes a plate-shaped rotor 83*a* rotatably supported by a pin 84 and a protrusion 83*b* extending from the rotor 83*a* toward the latch 85. The protrusion 83*b* is in contact with the other end of the latch 85. The end of the rotor 83*a* near the link rod 63 is in contact with the other end of the link rod 63.

The link rod 63 is rotatably supported by a pin 64. The pin 64 is fixed to the fixing member 64*a*. As described above, since one end of the link rod 63 sandwiches the head of the plunger 61, the link rod 63 rotates around the pin 64 as the plunger 61 moves up and down. One end of a plunger push spring 62 is connected to the link rod 63 at a position near one end thereof. The plunger push spring 62 is used to rotate the link rod 63 clockwise. The plunger push spring 62 is a spring that stores energy in a compressed state. The other end of the plunger push spring 62 is connected to the fixing member 64*a*.

A through hole extending in the Z-axis direction is formed in the upper link 88 at a position near one end thereof. A pin 88*a* provided on the rotor 81*b* is inserted into the through hole. By the pin 88*a* inserted, the upper link 88 is rotatably supported. A through hole extending in the Z-axis direction is formed in the upper link 88 at a position near the other end thereof. One end of the U shaft 87 is inserted into the through hole. The other end of the U shaft 87 is inserted into a through hole formed in the lever 86.

A through hole extending in the Z-axis direction is formed in the lower link 89 at a position near one end thereof. One end of the U shaft 87 is inserted into the through hole. A through hole extending in the Z-axis direction is formed in the lower link 89 at a position near the other end thereof. A pin 95*a* provided on an arm 90 at a position near the other end thereof is inserted into the through hole.

The arm 90 is rotatably supported by an arm pin 91 that is a support shaft. An arm link pin 92 is provided at the end of the arm 90 near the opening lever 82. The arm 90 is connected to the other end 82*b* of the opening lever 82 via the arm link pin 92. The opening lever 82 is a member that pushes down the second crossbar 53*b* in conjunction with the operation of the plunger 61. That is, the opening lever 82 is a member that pushes the second crossbar 53*b* in a direction away from the first crossbar 53*a* in conjunction with the operation of the plunger 61. The opening lever 82 is rotatably supported by a pin 93. The pin 93 is fixed to a metal wall (not illustrated). The one end 82*a* of the opening lever 82 is located in the through hole 17*b*. Note that two opening levers 82 are provided in the Z-axis direction. Details of the configuration of the opening lever 82 will be described later.

A switch lever 95 for turning the operation coil switch 94 on or off is provided at the end of the arm 90 near the trip coil 60. The arm 90 and the switch lever 95 may be manufactured through integral molding by die casting using a conductive member, or may be combined with each other after being manufactured individually. The switch lever 95 is provided near the operation coil switch 94. The switch lever 95 is a lever for turning the operation coil switch 94 on or off in conjunction with the opening lever 82.

Note that the power-side outer conductor 300, the power-side terminal 1, the power-side fixed contact 3, the power-side fixed contact point 4, the power-side movable contact point 5, the movable contact 6, the load-side fixed contact 9, the load-side terminal 11, and the load-side outer conductor 400 are provided for each of the U phase, the V phase, and the W phase as illustrated in FIG. 2.

Next, the operation of the contactor 100 will be described.

FIG. 3 is a diagram illustrating the states of the handle illustrated in FIG. 1 and contact point states. On the upper side of FIG. 3, three kinds of states of the handle 81: "OFF", "READY", and "TRIP" are illustrated. Contact point states are illustrated on the lower side of FIG. 3. There are two kinds of contact point states: an open state in which the movable contact point is separated from the fixed contact point, and a closed state in which the movable contact point is in contact with the fixed contact point. In FIG. 3, the open state is described as "OPEN", and the closed state is described as "CLOSED".

The handle 81 in "OFF" is tilted to the right. When the state of the handle 81 is "OFF", the movable contact point is separated from the fixed contact point by the opening lever 82 regardless of whether current is supplied from the external power supply 500, so that the contact points are "OPEN" and the operation coil switch 94 is off.

In "READY", remote opening/closing operation can be performed on the contact points, and the contact points can be automatically opened when an overcurrent occurs. Remote opening/closing operation includes the operation of remotely closing the contact points by turning on the output of the external power supply 500 to apply current output from the external power supply 500 to the operation coil 50, and the operation of remotely opening the contact points by turning off the output of the external power supply 500 to cut off the supply of current from the external power supply 500 to the operation coil 50. An overcurrent is, for example, a current that flows when a load (not illustrated) connected to the load-side outer conductor 400 illustrated in FIG. 2 is short-circuited, a current that flows when the load-side outer conductor 400 has a ground fault, or the like. A ground fault is a state in which the load-side outer conductor 400 and the ground are electrically connected via the impedance formed therebetween.

The state of the handle 81 in "READY" is tilted to the left. When the state of the handle 81 is "READY" and the output of the external power supply 500 is off, the contact points are "OPEN". When the state of the handle 81 is "READY" and the output of the external power supply 500 is on, the contact points are "CLOSED".

"TRIP" is a state in which the contact points are forcibly opened when an overcurrent occurs while the state of the handle 81 is "READY". The position of the handle 81 in "TRIP" is between the position of the handle 81 in "OFF" and the position of the handle 81 in "READY".

Next, a description will be given of how the contactor 100 operates when the state of the handle 81 is "OFF" with reference to FIGS. 4 and 5.

Figure 4:
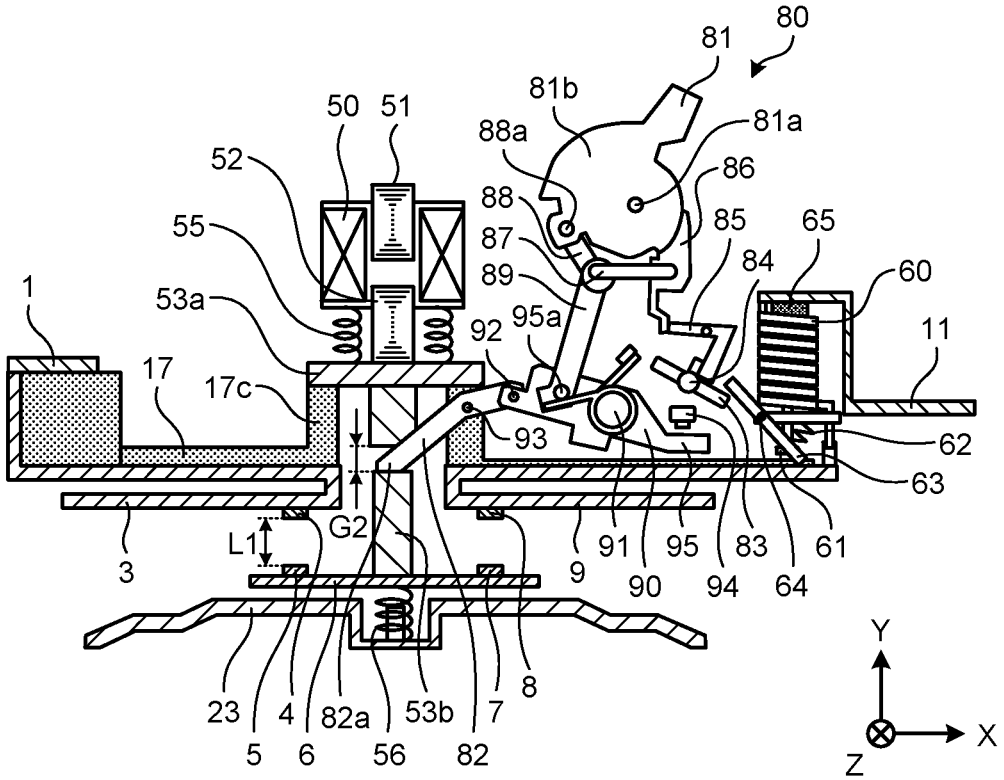
FIG. 4 is a view illustrating the state of the manual control mechanism and the contact points when the state of the handle illustrated in FIG. 1 is "OFF".

FIG. 4 is a view illustrating the state of the manual control mechanism and the contact points when the state of the handle illustrated in FIG. 1 is "OFF". In FIG. 4, only some of the elements constituting the contactor 100 illustrated in FIG. 1, such as the manual control mechanism 80, the operation coil 50, the fixed iron core 51, the movable iron core 52, the first crossbar 53*a*, and the second crossbar 53*b*, are illustrated, and the other elements are not illustrated. FIG. 5 is a view of the tripping spring, the operation coil, the fixed iron core, the movable iron core, the crossbars, the opening levers, and the like illustrated in FIG. 4, seen in the X-axis direction. In FIG. 5, three-pole power-side fixed contacts 3 and three-pole power-side fixed contact points 4 are illustrated.

As illustrated in FIG. 4, as the handle 81 is rotated clockwise, the state of the handle 81 becomes "OFF". At this time, the rotor 81*b* rotates clockwise around the pin 81*a*. Along with the rotation of the rotor 81*b*, the upper link 88 connected to the rotor 81*b* moves in the upper left direction. Along with the movement of the upper link 88, the lower link 89 connected to the upper link 88 moves upward, so that the arm 90 rotates clockwise around the arm pin 91. At this time, the opening lever 82 connected to the arm link pin 92 rotates counterclockwise around the pin 93, so that the one end 82*a* of the opening lever 82 pushes down the second crossbar 53*b* against the restoring force of the push spring 56. When the second crossbar 53*b* is lowered, the movable contact 6 is moved downward and the movable contact point is moved away from the fixed contact point, so that the contact points are opened.

When the arm 90 rotates clockwise around the arm pin 91, the switch lever 95 moves away from the operation coil switch 94. Accordingly, the operation coil switch 94 is turned off as illustrated in FIG. 2, and the operation coil 50 is not electrically connected to the external power supply 500 illustrated in FIG. 2. That is, even when the output of the external power supply 500 is on, no current flows through the operation coil 50 and the operation coil 50 is not excited. In this case, since no electromagnetic force for attracting the movable iron core 52 is generated, the movable iron core 52 is moved away from the fixed iron core 51 by the restoring force of the tripping spring 55. The movable iron core 52 and the first crossbar 53*a* away from the fixed iron core 51 move downward together. Once the first crossbar 53*a* comes into contact with the protrusion 17*c*, the movement of the movable iron core 52 and the first crossbar 53*a* stops. The position at which the upper end of the movable iron core 52 is located when the first crossbar 53*a* is in contact with the protrusion 17*c* is hereinafter referred to as the "bottom dead center" of the movable iron core 52. The bottom dead center is the same as the position beyond which the movable iron core 52 cannot move downward.

Figure 5:
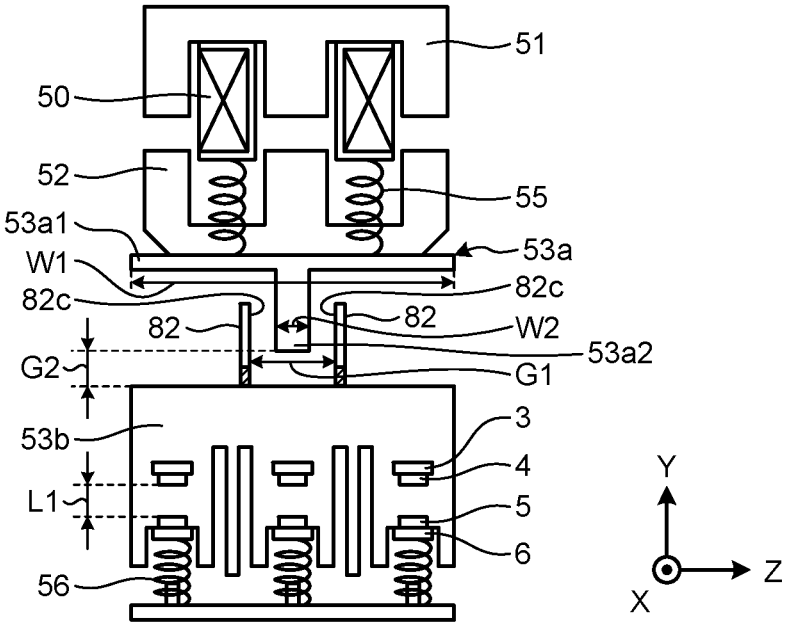
FIG. 5 is a view of the tripping spring, the operation coil, the fixed iron core, the movable iron core, the crossbars, the opening levers, and the like illustrated in FIG. 4, seen in the X-axis direction.

As illustrated in FIG. 5, the plate 53*a*1 is a member extending in a direction orthogonal to the moving direction of the first crossbar 53*a*. The projection 53*a*2 is a member provided on the plate 53*a*1 and extending from the plate 53*a*1 toward the second crossbar 53*b*. The projection 53*a*2 is provided at the middle portion of the plate 53*a*1 in the Z-axis direction. The lower end of the projection 53*a*2 faces the middle portion of the first crossbar 53*a* in the Z-axis direction. Assuming that the width of the plate 53*a*1 in the direction orthogonal to the moving direction of the first crossbar 53*a* is W1 and the width of the projection 53*a*2 in the orthogonal direction is W2, W2 is narrower than W1. As illustrated in FIG. 5, the two opening levers 82 sandwich the projection 53*a*2. The one ends 82*a* of the two opening levers 82 are separated in the Z-axis direction. The one end 82*a* of each of the two opening levers 82 is provided on the upper end of the second crossbar 53*b* at a position near the middle portion in the Z-axis direction. Since end faces 82*c* of the two opening levers 82 facing the projection 53*a*2 face each other, a gap G1 is formed between the one ends 82*a* of the two opening levers 82. In FIG. 5, a part of the projection 53*a*2 exists in the gap G1. The width W2 of the projection 53*a*2 is narrower than the gap G1.

When the widths of the first crossbar 53*a* and the second crossbar 53*b* are the same, it is necessary to take measures such as providing a member for bringing the opening lever 82 into contact with the second crossbar 53*b* on the second crossbar 53*b* and providing a groove to which the opening lever 82 is inserted on the upper end of the second crossbar 53*b*. Therefore, the mass of the second crossbar 53*b* increases, or the structure of the second crossbar 53*b* becomes complicated. On the other hand, as illustrated in FIG. 5, the configuration in which the two opening levers 82 sandwich the projection 53*a*2 enables the one end 82*a* of the opening lever 82 to be located between the second crossbar 53*b* and the plate 53*a*1. In addition, since the first crossbar 53*a* is T-shaped, the amount of material used for manufacturing the first crossbar 53*a* is small, as compared with the case where the entire width of the first crossbar 53*a* is equal to the width of the second crossbar 53*b*.

The configuration in which the two opening levers 82 sandwich the projection 53*a*2 is advantageous in reducing an increase in the inclination angle of the upper end face and the lower end face of the second crossbar 53*b* with respect to the virtual plane parallel to the Z-axis direction when pushing down the second crossbar 53*b* in response to an overcurrent, as compared with the case where the second crossbar 53*b* is pushed down by a single opening lever 82. Therefore, the three-pole movable contact points can be simultaneously separated from the three-pole fixed contact points when an overcurrent occurs, and the three-pole contact points can be opened or closed at the same time.

When the second crossbar 53*b* is pushed down by the one end 82*a* of each of the two opening levers 82, the movable contact point exists at a position separated from the fixed contact point by an inter-contact distance L1. When the second crossbar 53*b* is pushed down, a gap G2 is formed between the lower end of the projection 53*a*2 of the first crossbar 53*a* and the upper end of the second crossbar 53*b*.

Next, remote opening/closing operation will be described with reference to FIGS. 6 to 10.

Figure 6:
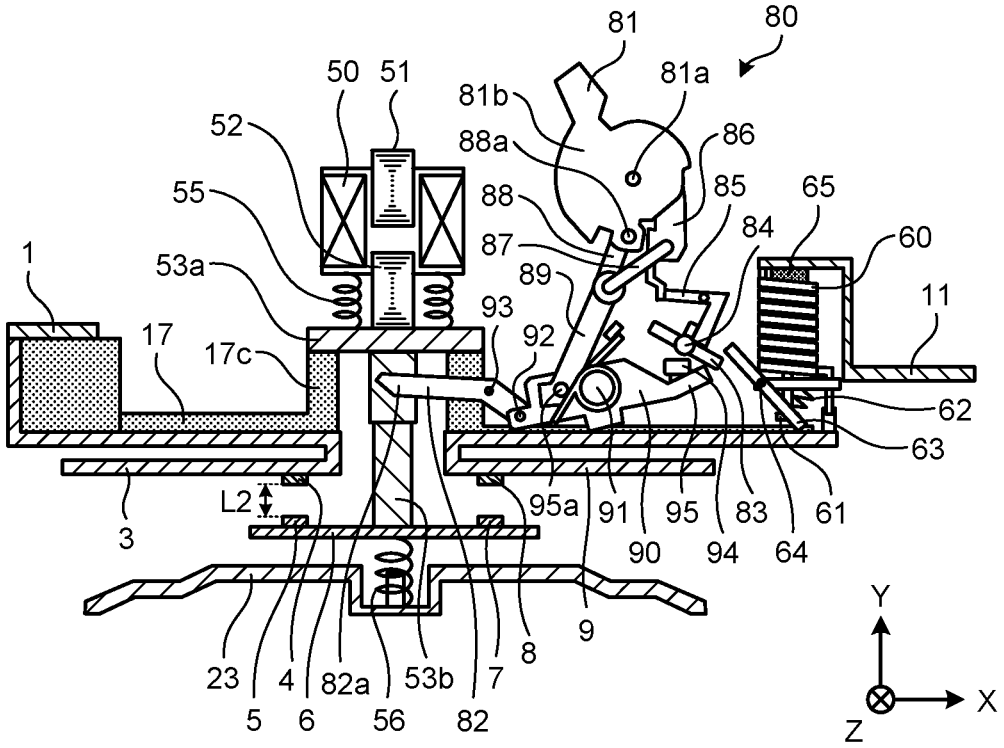
FIG. 6 is a view illustrating the state of the manual control mechanism when the state of the handle illustrated in FIG. 1 is "READY" and the contact points are opened.
Figure 7:
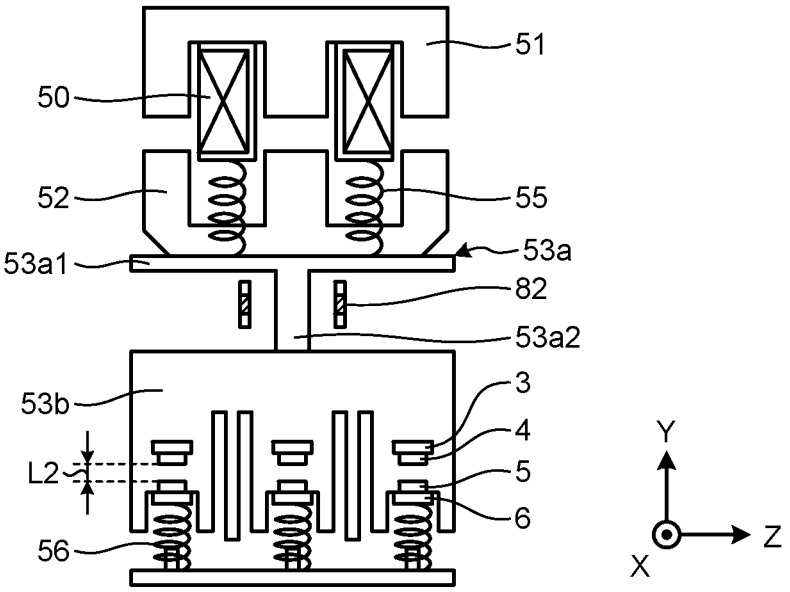
FIG. 7 is a view of the tripping spring, the operation coil, the fixed iron core, the movable iron core, the crossbars, the opening levers, and the like illustrated in FIG. 6, seen in the X-axis direction.

FIG. 6 is a view illustrating the state of the manual control mechanism when the state of the handle illustrated in FIG. 1 is "READY" and the contact points are opened. In FIG. 6, only some of the elements constituting the contactor 100 illustrated in FIG. 1 are illustrated, as in FIG. 4. FIG. 7 is a view of the tripping spring, the operation coil, the fixed iron core, the movable iron core, the crossbars, the opening levers, and the like illustrated in FIG. 6, seen in the X-axis direction. In FIG. 7, three-pole power-side fixed contacts 3 and three-pole power-side fixed contact points 4 are illustrated, as in FIG. 5.

As illustrated in FIG. 6, as the handle 81 is rotated counterclockwise, the state of the handle 81 becomes "READY". At this time, the rotor 81*b* rotates counterclockwise around the pin 81*a*. Along with the rotation of the rotor 81*b*, the upper link 88 connected to the rotor 81*b* moves downward while rotating clockwise. Along with the movement of the upper link 88, the lower link 89 connected to the upper link 88 moves downward. Therefore, the arm 90 rotates counterclockwise around the arm pin 91.

At this time, the opening lever 82 connected to the arm link pin 92 rotates clockwise around the pin 93, so that the one end 82*a* of the opening lever 82 moves away from the upper end of the second crossbar 53*b*. Then, due to the restoring force of the push spring 56, the movable contact 6 and the second crossbar 53*b* move upward, and the upper end of the second crossbar 53*b* comes into contact with the lower end of the first crossbar 53*a*.

Since the restoring force of the tripping spring 55 is stronger than the restoring force of the push spring 56, even when a force that pushes up the first crossbar 53*a* acts on the first crossbar 53*a* from the second crossbar 53*b*, the plate 53*a*1 of the first crossbar 53*a* is pushed back by the tripping spring 55, and thus does not move upward. Accordingly, the plate 53*a*1 of the first crossbar 53*a* remains in contact with the protrusion 17*c* of the partition plate 17. At this time, the movable contact point exists at a position separated from the fixed contact point by an inter-contact distance L2. The inter-contact distance L1 illustrated in FIG. 4 is longer than the inter-contact distance L2 illustrated in FIG. 6.

When the arm 90 rotates counterclockwise around the arm pin 91, the switch lever 95 provided on the arm 90 turns the operation coil switch 94 on. In this state, when a current supplied from the external power supply 500 illustrated in FIG. 2 flows to the operation coil 50, the operation coil 50 is excited and an electromagnetic force for attracting the movable iron core 52 is generated.

Figure 8:
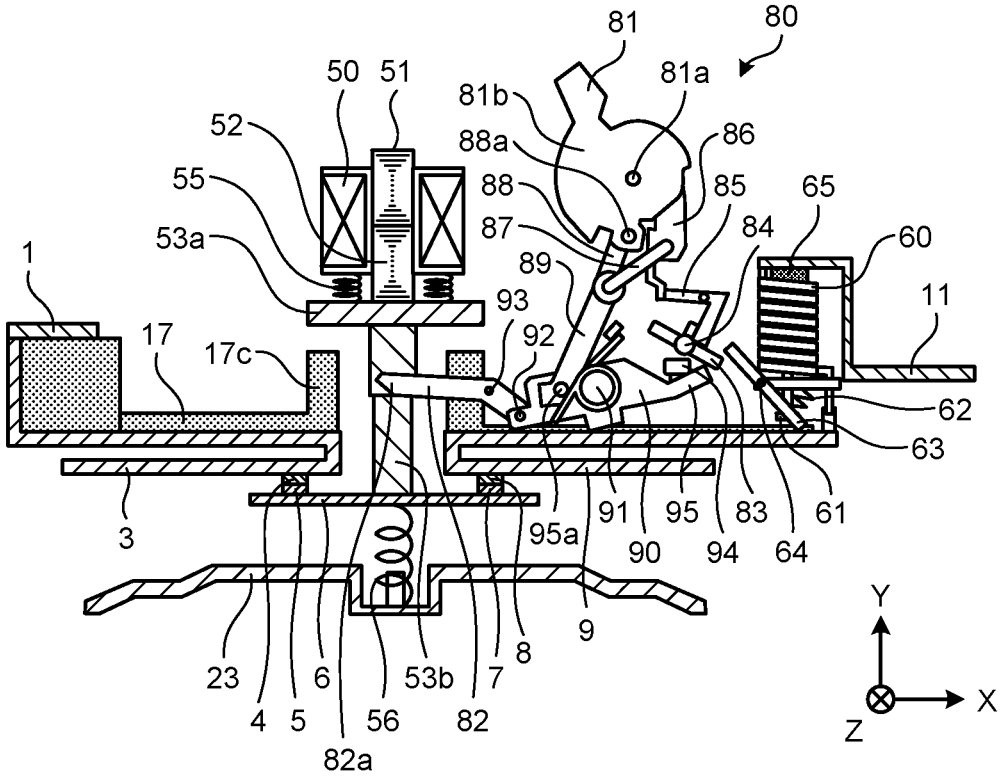
FIG. 8 is a view illustrating how the movable iron core illustrated in FIG. 6 moves upward against the restoring force of the tripping spring and comes into contact with the fixed iron core.
Figure 9:
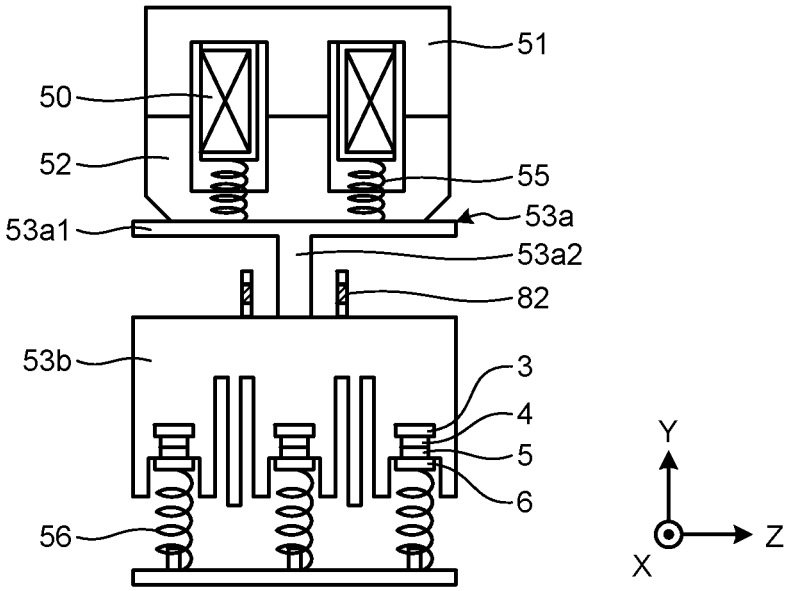
FIG. 9 is a view of the tripping spring, the operation coil, the fixed iron core, the movable iron core, the crossbars, the opening levers, and the like illustrated in FIG. 8, seen in the X-axis direction.

FIG. 8 is a view illustrating how the movable iron core illustrated in FIG. 6 moves upward against the restoring force of the tripping spring and comes into contact with the fixed iron core. That is, FIG. 8 depicts the state of the movable iron core when the state of the handle 81 is "READY" and the contact points are closed. In FIG. 8, only some of the elements constituting the contactor 100 illustrated in FIG. 1 are illustrated, as in FIG. 4. FIG. 9 is a view of the tripping spring, the operation coil, the fixed iron core, the movable iron core, the crossbars, the opening levers, and the like illustrated in FIG. 8, seen in the X-axis direction. In FIG. 9, three-pole power-side fixed contacts 3 and three-pole power-side fixed contact points 4 are illustrated, as in FIG. 5.

When an electromagnetic force is generated by exciting the operation coil 50, the restoring force of the tripping spring 55 is canceled by the attractive force of the electromagnetic force. Therefore, the movable iron core 52 moves upward against the restoring force of the tripping spring 55 and stops once it comes into contact with the fixed iron core 51. The position at which the upper end of the movable iron core 52 is located when the movable iron core 52 is in contact with the fixed iron core 51 is hereinafter referred to as the "top dead center" of the movable iron core 52. The top dead center is the same as the position beyond which the movable iron core 52 cannot move upward.

The second crossbar 53*b* and the movable contact 6 move upward due to the restoring force of the push spring 56. Consequently, the movable contact point comes into contact with the fixed contact point, and the contact points are closed. Since the contact points are closed, the main current supplied from the power-side outer conductor 300 illustrated in FIG. 2 flows to the load-side outer conductor 400 through the power-side terminal 1, the power-side fixed contact 3, the power-side fixed contact point 4, the power-side movable contact point 5, the movable contact 6, the load-side movable contact point 7, the load-side fixed contact point 8, the load-side fixed contact 9, the trip coil 60, and the load-side terminal 11. Hereinafter, the main current supplied from the power-side outer conductor 300 is simply referred to as "main current".

After the contact points are closed, the external power supply 500 is turned off, and the supply of current to the operation coil 50 is stopped. Then, the first crossbar 53*a* moves downward until it comes into contact with the protrusion 17*c* of the partition plate 17 due to the restoring force of the tripping spring 55. As the first crossbar 53*a* moves downward, the second crossbar 53*b* is pushed by the first crossbar 53*a*, and the movable contact point moves away from the fixed contact point. The movable contact point away from the fixed contact point stops at a position separated by the inter-contact distance L2 illustrated in FIG. 6. In this state, when the handle 81 is manually operated to the off position, the movable contact point stops at a position separated by the inter-contact distance L1 illustrated in FIG. 4. Further, since the operation coil switch 94 is turned off by operating the handle 81 to the off position, even when the output of the external power supply 500 is turned on, the attractive force of the operation coil 50 is lost, and the contact state between the protrusion 17*c* and the first crossbar 53*a* is maintained due to the restoring force of the tripping spring 55.

Figure 10:
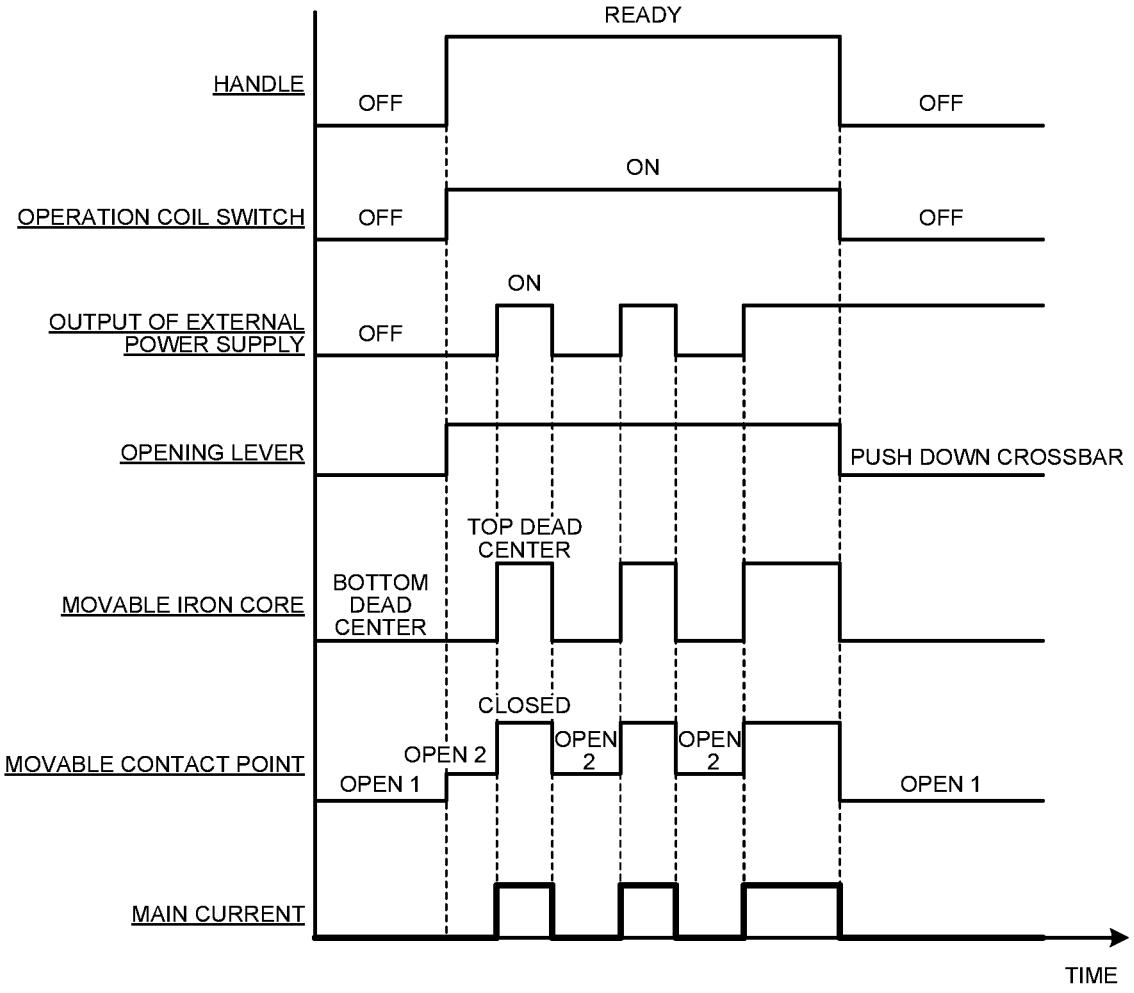
FIG. 10 is a timing chart illustrating how the contactor according to the embodiment performs remote opening/closing operation.

FIG. 10 is a timing chart illustrating how the contactor according to the embodiment performs remote opening/closing operation. In FIG. 10, the state of the handle 81, the state of the operation coil switch 94, the output state of the external power supply 500, the position of the one end 82*a* of the opening lever 82, the position of the movable iron core 52, the position of the movable contact point, and the state of the main current are illustrated in order from the top.

When the state of the handle 81 is "OFF", since the operation coil switch 94 is off, the operation coil 50 generates no attractive force, and the movable iron core 52 is located at the bottom dead center. When the state of the handle 81 is "OFF", the one end 82*a* of the opening lever 82 pushes down the second crossbar 53*b*, so that the movable contact point exists at a position separated from the fixed contact point by the inter-contact distance L1 as illustrated in FIG. 4. In FIG. 10, the position of the movable contact point located at a position separated from the fixed contact point by the inter-contact distance L1 is indicated as "OPEN 1".

As the state of the handle 81 changes from "OFF" to "READY", the state of the operation coil switch 94 changes from off to on, and the one end 82*a* of the opening lever 82 moves away from the second crossbar 53*b*. At this time, when the output of the external power supply 500 is off, the movable contact point moved upward by the restoring force of the push spring 56 exists at a position separated from the fixed contact point by the inter-contact distance L2 as illustrated in FIG. 6. In FIG. 10, the position of the movable contact point that exists at a position separated from the fixed contact point by the inter-contact distance L2 is indicated as "OPEN 2".

If the output of the external power supply 500 changes from off to on when the state of the movable contact point is "OPEN 2", current flows through the operation coil 50, the movable iron core 52 rises to the top dead center, and the movable contact point comes into contact with the fixed contact point. In FIG. 10, the position of the movable contact point that contacts the fixed contact point is indicated as "CLOSED". Consequently, the main current flows.

When the state of the handle 81 is "READY", remote opening/closing operation is performed by changing the output of the external power supply 500 from off to on or from on to off. After that, when the handle 81 is manually operated and the state of the handle 81 changes from "READY" to "OFF", the one end 82*a* of the opening lever 82 pushes down the second crossbar 53*b*, whereby the position of the movable contact point returns to "OPEN 1".

Figure 11:
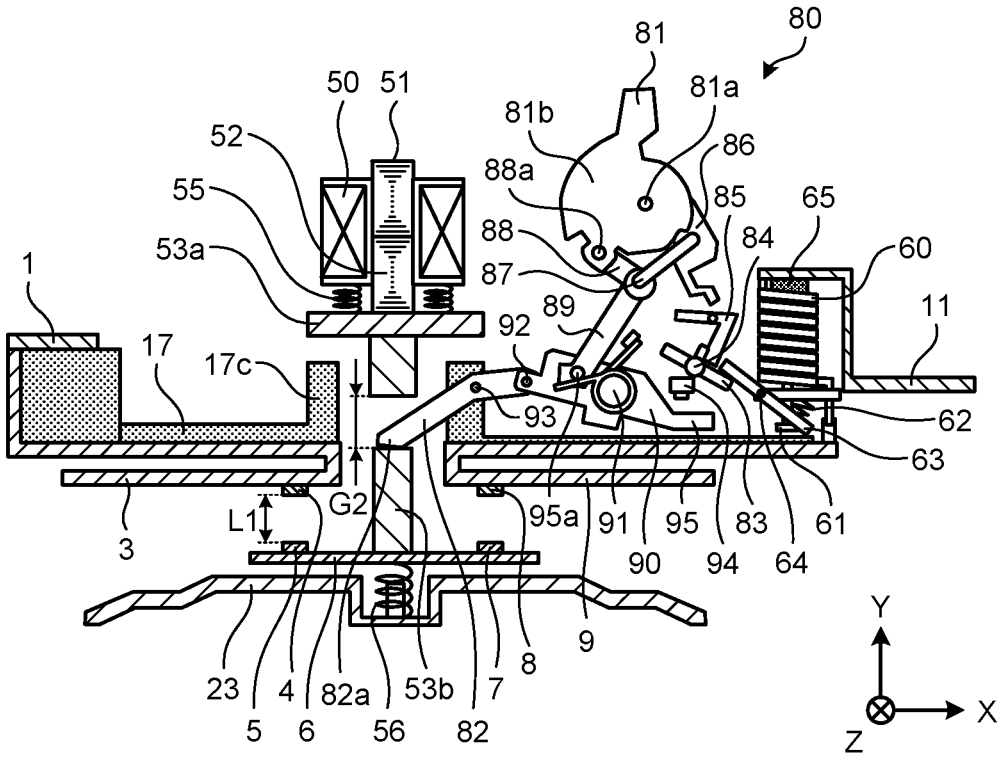
FIG. 11 is a view illustrating the state of the manual control mechanism immediately after an overcurrent occurs when the state of the handle illustrated in FIG. 8 is ready and the contact points are closed.
Figure 12:
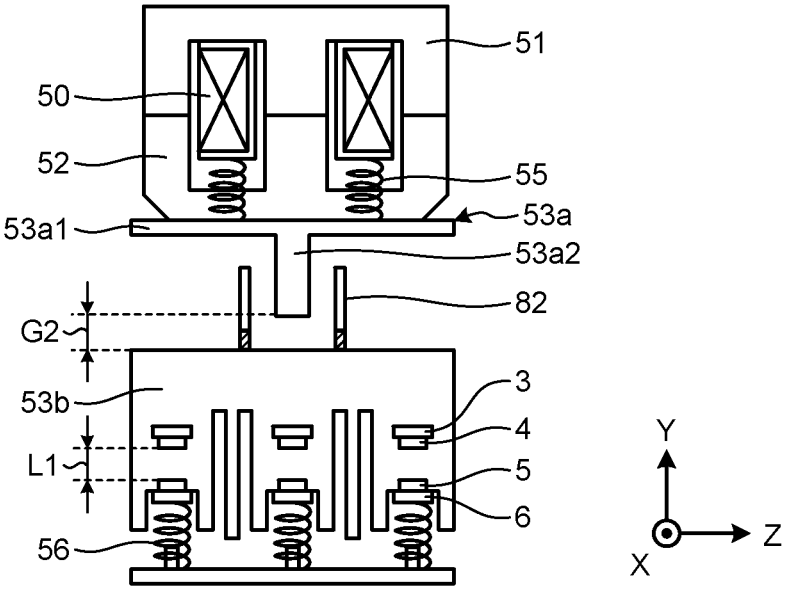
FIG. 12 is a view of the tripping spring, the operation coil, the fixed iron core, the movable iron core, the crossbars, the opening levers, and the like illustrated in FIG. 11, seen in the X-axis direction.

Next, the operation in which an overcurrent flows to cause automatic opening will be described. FIG. 11 is a view illustrating the state of the manual control mechanism immediately after an overcurrent occurs when the state of the handle illustrated in FIG. 8 is ready and the contact points are closed. In FIG. 11, only some of the elements constituting the contactor 100 illustrated in FIG. 1 are illustrated, as in FIG. 4. FIG. 12 is a view of the tripping spring, the operation coil, the fixed iron core, the movable iron core, the crossbars, the opening levers, and the like illustrated in FIG. 11, seen in the X-axis direction. In FIG. 12, three-pole power-side fixed contacts 3 and three-pole power-side fixed contact points 4 are illustrated, as in FIG. 5.

As described with reference to FIG. 8, when the contact points are closed, a current flows through the trip coil 60, so that an attractive force acts on the plunger 61 due to the electromagnetic force generated from the trip coil 60. However, since the attractive force generated in the plunger 61 at this time is weaker than the restoring force of the plunger push spring 62, the lower end of the plunger 61 stops at the position farthest from the trip coil 60.

When the contact points are closed, if an overcurrent occurs and the value of the current flowing through the trip coil 60 exceeds a predetermined value, the magnetic path formed by the magnetic field generated by the trip coil 60, the load-side terminal 11 that is a magnetic material, and the plunger 61 causes the plunger 61 to move upward against the restoring force of the plunger push spring 62.

As the plunger 61 moves upward, the link rod 63 rotates counterclockwise around the pin 64. Consequently, the magnetic bar 83 rotates clockwise around the pin 84. As the magnetic bar 83 rotates, the latch 85 rotates counterclockwise, and the tip of the lever 86 is disengaged from the latch 85. As the tip of the lever 86 is disengaged from the latch 85, the handle 81 rotates clockwise around the pin 81*a*. The position of the handle 81 illustrated in FIG. 11 corresponds to the state of the handle 81 in "TRIP" illustrated in FIG. 3. For the rotation of the handle 81, for example, the restoring force of a torsion spring (not illustrated) provided on the pin 81*a* is used.

As the tip of the lever 86 is disengaged from the latch 85, the handle 81 rotates clockwise, and the lever 86 rotates counterclockwise around the pin 81*a*. The upper link 88 connected to the U shaft 87 and the handle 81 moves upward as a whole, with its upper end moving in the upper left direction and its lower end moving in the upper right direction. Since the lower link 89 connected to the upper link 88 moves in the upper right direction as a whole, the arm 90 connected to the lower link 89 rotates clockwise around the arm pin 91.

As the arm 90 rotates clockwise, the opening lever 82 connected to the arm 90 via the arm link pin 92 rotates counterclockwise around the pin 93. At this time, the one end 82*a* of the opening lever 82 pushes down the second crossbar 53*b*, thereby opening the contact points.

In FIG. 6, the movable contact point exists at a position separated from the fixed contact point by the inter-contact distance L2. On the other hand, in FIG. 11, the movable contact point exists at a position separated from the fixed contact point by the inter-contact distance L1. That is, since the first crossbar 53*a* is in contact with the protrusion 17*c* of the partition plate 17 during remote opening/closing operation, the movable contact point exists at the position of the inter-contact distance L2. On the other hand, when an overcurrent occurs, the second crossbar 53*b* is pushed down by the opening lever 82, so the movable contact point moves downward from the position of the inter-contact distance L2 by the push-down amount provided by the opening lever 82. Therefore, the inter-contact distance L1 after the occurrence of the overcurrent is longer than the inter-contact distance L2 before the occurrence of the overcurrent as illustrated in FIG. 6. At this time, a gap G3 is generated between the lower end of the projection 53*a*2 of the first crossbar 53*a* and the upper end of the second crossbar 53*b*.

As described above, the inter-contact distance is increased when an overcurrent occurs, so the insulation distance is longer than when the movable contact point is at the position of the inter-contact distance L2, whereby an arc generated between the fixed contact point and the movable contact point can be easily extinguished. Arc extinguishing is to extinguish an arc generated between the fixed contact point and the movable contact point.

Further, since the opening lever 82 moves only the second crossbar 53*b*, the movable contact 6, and the movable contact point, the weight is reduced and the opening speed is increased. Increasing the opening speed leads to quick extinguishment of an arc generated between the contact points, so that the interruption performance of the contactor 100 is improved. For example, as compared with the case where the first crossbar 53*a* and the second crossbar 53*b* are not separated and the opening lever 82 moves the second crossbar 53*b*, the movable contact 6, and the movable contact point and also moves the first crossbar 53*a* and the movable iron core 52, the weight of the components to be driven by the opening lever 82 is reduced, so that the opening speed is increased.

Figure 13:
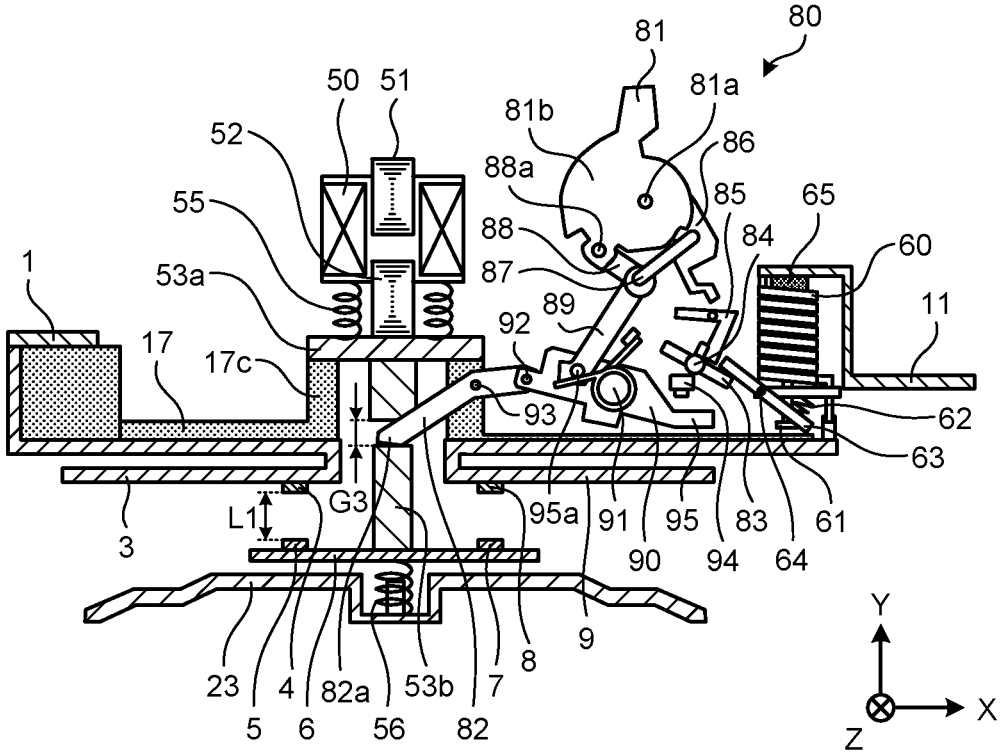
FIG. 13 is a view illustrating how the crossbar comes into contact with the protrusion when the operation coil switch illustrated in FIG. 11 is turned off.
Figure 14:
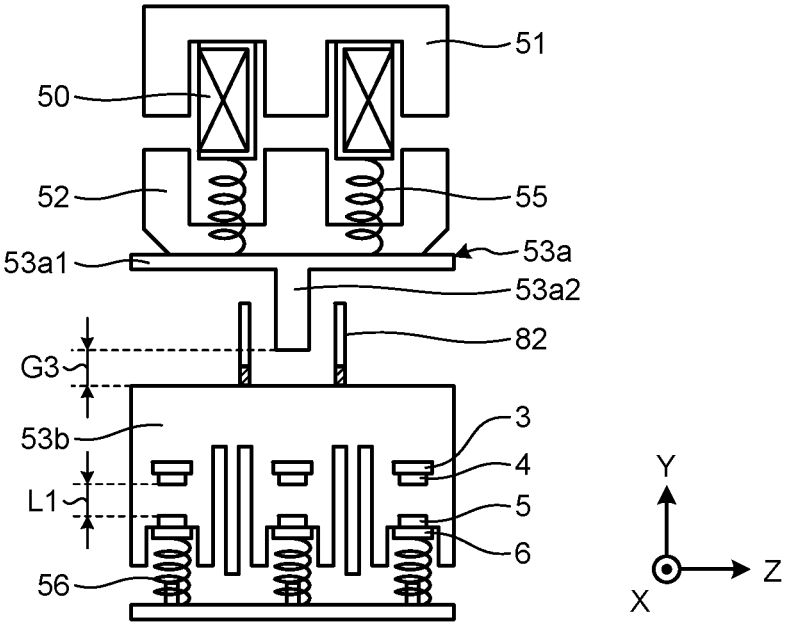
FIG. 14 is a view of the tripping spring, the operation coil, the fixed iron core, the movable iron core, the crossbars, the opening levers, and the like illustrated in FIG. 13, seen in the X-axis direction.

FIG. 13 is a view illustrating how the crossbar comes into contact with the protrusion when the operation coil switch illustrated in FIG. 11 is turned off. In FIG. 13, only some of the elements constituting the contactor 100 illustrated in FIG. 1 are illustrated, as in FIG. 4. FIG. 14 is a view of the tripping spring, the operation coil, the fixed iron core, the movable iron core, the crossbars, the opening levers, and the like illustrated in FIG. 13, seen in the X-axis direction. In FIG. 14, three-pole power-side fixed contacts 3 and three-pole power-side fixed contact points 4 are illustrated, as in FIG. 5.

When the handle 81 rotates clockwise due to the occurrence of an overcurrent, the switch lever 95 also rotates clockwise, so that the operation coil switch 94 is turned off. When the operation coil switch 94 is turned off, the supply of current to the operation coil 50 stops, so that the movable iron core 52 and the first crossbar 53*a* move downward, and the movement of the movable iron core 52 and the first crossbar 53*a* stops once the first crossbar 53*a* comes into contact with the protrusion 17*c*. In this manner, by providing the switch lever 95, the operation coil 50 can be de-energized at the same time as opening operation is performed when an overcurrent occurs. FIGS. 13 and 14 depict how the first crossbar 53*a* moves downward and comes into contact with the protrusion 17*c* in response to the operation coil switch 94 being turned off. This state is referred to as a trip operation completion state.

The overall mass of the first crossbar 53*a* and the movable iron core 52 is larger than the mass of the first crossbar 53*a* alone, so the inertia of the first crossbar 53*a* and the movable iron core 52 is larger than the inertia of the first crossbar 53*a* alone. Therefore, even though the opening lever 82 and the switch lever 95 start to rotate at the same time to open the contact points and turn off the operation coil switch 94, the timing at which the movable iron core 52 starts to move is later than the timing at which the contact points are opened by the opening lever 82.

When the contact points are opened, an arc is generated between the contact points. Since each of the power-side fixed contact 3 and the load-side fixed contact 9 has an X-Y cross section of a U shape, the Lorentz force in the direction opposite to the direction from the power-side fixed contact 3 toward the second crossbar 53*b* is generated by the power-side fixed contact 3, and the Lorentz force in the direction opposite to the direction from the load-side fixed contact 9 toward the second crossbar 53*b* is generated by the load-side fixed contact 9. Consequently, an arc generated between the power-side fixed contact point 4 and the power-side movable contact point 5 flows between the power-side fixed contact 3 and the arc runner 23 and enters the power-side grid 21. Similarly, an arc generated between the load-side fixed contact point 8 and the load-side movable contact point 7 flows between the load-side fixed contact 9 and the arc runner 23 and enters the load-side grid 22.

The voltage of the arc rises due to the cathode fall voltage generated when the arc touches the power-side grid 21 and the load-side grid 22, and the voltage of the arc rises when the arc touches the cooled air flowing through the power-side grid 21 and the load-side grid 22. Due to the rise of the voltage of the arc, the current generated in the arc is limited, and an interruption state is established.

The high temperature air around the power-side grid fixer 24 heated by the arc passes through the power-side grid fixer window 25, further passes through the lower case power-side window 28, and is discharged out of the lower case 15. Similarly, the high temperature air around the load-side grid fixer 26 heated by the arc passes through the load-side fixer window 27, further passes through the lower case load-side window 29, and is discharged out of the lower case 15.

In order to close the contact points again after the arc is extinguished, the handle 81 only needs to be turned off temporarily as illustrated in FIG. 4 and then put in the ready state as illustrated in FIG. 6. Since the operation coil switch 94 is not turned on unless the handle 81 is manually set to the ready state, the contact points are not automatically closed immediately after the arc is extinguished.

Figure 15:
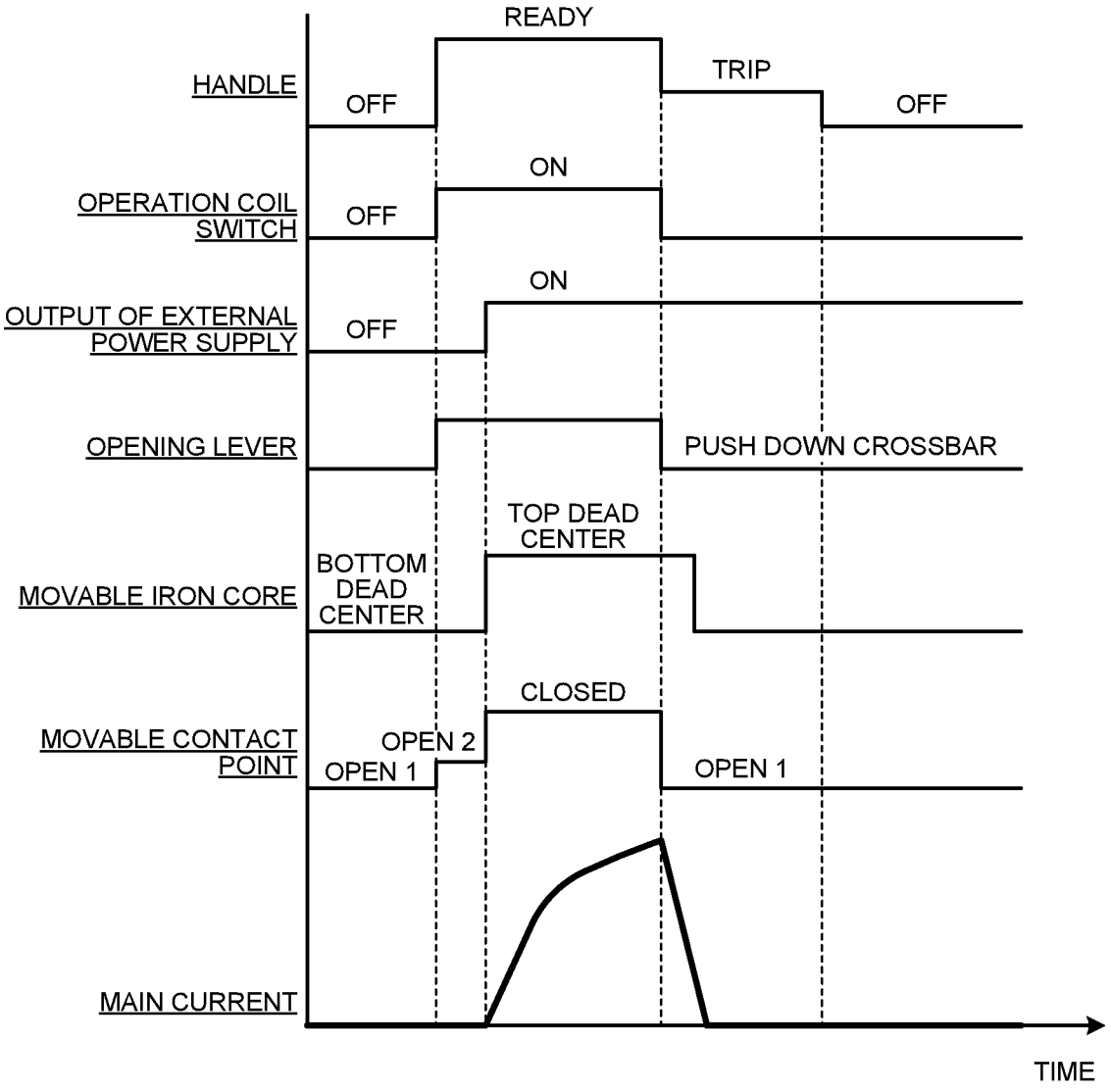
FIG. 15 is a timing chart illustrating how the contactor according to the embodiment performs overcurrent interrupting operation.

FIG. 15 is a timing chart illustrating how the contactor according to the embodiment performs overcurrent interrupting operation. In FIG. 15, as in FIG. 10, the state of the handle 81, the state of the operation coil switch 94, the output state of the external power supply 500, the position of the one end 82*a* of the opening lever 82, the position of the movable iron core 52, the position of the movable contact point, and the state of the main current are illustrated in order from the top.

Since the operation that is performed when the state of the handle 81 is "OFF" and the operation that is performed when the state of the handle 81 is changed from "OFF" to "READY" are the same as those in FIG. 10, descriptions thereof are omitted. If the output of the external power supply 500 changes from off to on when the state of the movable contact point is "OPEN 2", current flows through the operation coil 50, the movable iron core 52 rises to the top dead center, and the movable contact point comes into contact with the fixed contact point. If an overcurrent occurs while the movable contact point is in contact with the fixed contact point, a current exceeding the above-described predetermined value flows through the trip coil 60. As illustrated in FIG. 15, when a current exceeding the predetermined value flows, the second crossbar 53*b* is pushed down by the opening lever 82. Consequently, the movable contact point is forcibly moved away from the fixed contact point, so that the position of the movable contact point changes from "CLOSED" to "OPEN 1". As the position of the movable contact point changes from "CLOSED" to "OPEN 1", the position of the handle 81 changes from "READY" to "TRIP".

At the same time, the operation coil switch 94 is turned off. Therefore, the position of the movable iron core 52 is changed from "TOP DEAD CENTER" to "BOTTOM DEAD CENTER" a predetermined time after the position of the movable contact point changes from "CLOSED" to "OPEN 1". The position of the movable iron core 52 changes from "TOP DEAD CENTER" to "BOTTOM DEAD CENTER". The trip state cannot shift to the "READY" state without temporarily shifting to the "OFF" state.

Figure 16:
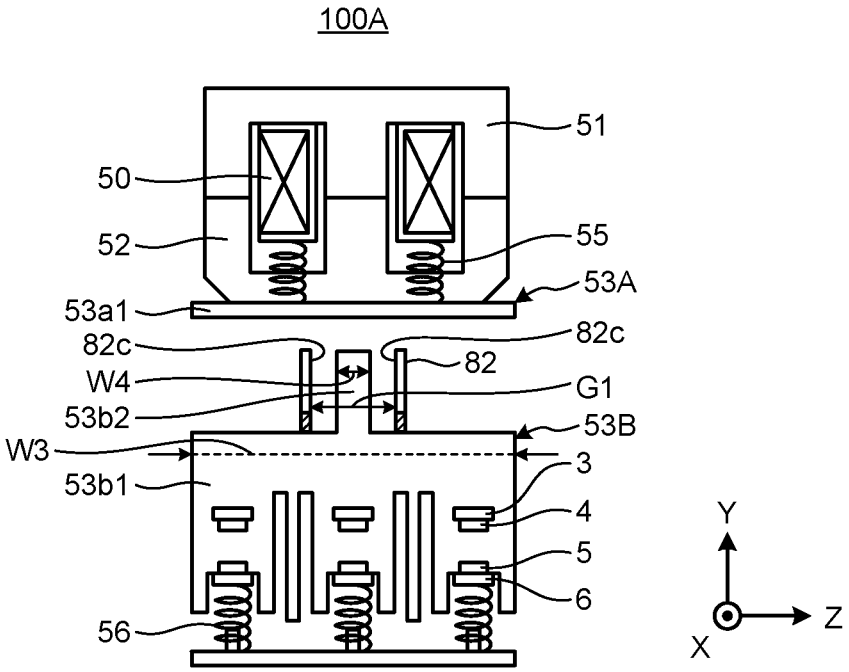
FIG. 16 is a view illustrating an exemplary configuration of a contactor according to a modification of the embodiment of the present invention.

FIG. 16 is a view illustrating an exemplary configuration of a contactor according to a modification of the embodiment of the present invention. A contactor 100A illustrated in FIG. 16 includes a first crossbar 53A instead of the first crossbar 53*a* illustrated in FIG. 1, and includes a second crossbar 53B instead of the second crossbar 53*b*.

The first crossbar 53A includes the plate 53*a*1 extending in a direction orthogonal to the moving direction of the first crossbar 53A. The moving direction is the vertical direction.

The second crossbar 53B includes a body 53*b*1 extending in a direction orthogonal to the moving direction of the first crossbar 53A and a projection 53*b*2 provided on the body 53*b*1 and extending from the body 53*b*1 toward the first crossbar 53A. Assuming that the width of the body 53*b*1 in the direction orthogonal to the moving direction of the first crossbar 53A is W3 and the width of the projection 53*b*2 in the orthogonal direction is W4, W4 is narrower than W3. As illustrated in FIG. 16, the two opening levers 82 sandwich the projection 53*b*2. The one ends 82*a* of the two opening levers 82 are separated in the Z-axis direction. The one end 82*a* of each of the two opening levers 82 is provided on the body 53*b*1 at a position near the middle portion in the Z-axis direction. Since the end faces 82*c* of the two opening levers 82 facing the projection 53*b*2 face each other, the gap G1 is formed between the one ends 82*a* of the two opening levers 82. The width W4 of the projection 53*b*2 is narrower than the gap G1.

In this manner, the configuration in which the two opening levers 82 sandwich the projection 53*b*2 enables the one end 82*a* of the opening lever 82 to be located between the first crossbar 53A and the body 53*b*1. In addition, since the second crossbar 53B is thinner on the upper side thereof, the amount of material used for manufacturing the second crossbar 53B is small, as compared with the case where the width of the projection 53*b*2 is equal to the width of the body 53*b*1.

As described above, in the contactor 100 according to the embodiment, since the first crossbar 53*a* and the second crossbar 53*b* move in the vertical direction every time remote opening/closing operation is performed, the inclination angle of the second crossbar 53*b* with respect to the vertical direction is smaller than that of the opening/closing operation lever disclosed in Patent Literature 1. Therefore, the inclination angle of the movable contact 6 fixed to the second crossbar 53*b* with respect to the horizontal direction is smaller than that of the movable contact disclosed in Patent Literature 1. Thus, in the contactor 100 according to the embodiment, the difference between the opening/closing timing of the power-side fixed contact point 4 and the power-side movable contact point 5 and the opening/closing timing of the load-side fixed contact point 8 and the load-side movable contact point 7 is small, as compared with the circuit breaker disclosed in Patent Literature 1. As a result, the progress of wear on the movable and fixed contact points due to arcs is restrained, and the life for opening/closing is extended.

Further, in the contactor 100 according to the embodiment, the first crossbar 53*a* and the second crossbar 53*b* move in the vertical direction every time remote opening/closing operation is performed. Therefore, as compared with the case where the crossbar performs rotary movement as in the technique of Patent Literature 1, the progress of wear on the contact surface between the first crossbar 53*a* and the second crossbar 53*b* is restrained.

Further, in the contactor 100 according to the embodiment, the opening lever 82 is provided on the arm 90 at a position closer to the first crossbar 53*a*, and the switch lever 95 is provided on the arm 90 at a position farther from the first crossbar 53*a*, or at a position opposite to the position closer to the first crossbar 53*a*. Therefore, the opening lever 82 can be shortened as compared with the case where the opening lever 82 is provided on the arm 90 at a position farther from the trip coil 60, and the operation coil 50 can be de-energized at the same time as opening operation is performed when an overcurrent occurs. Thus, even when the space in the housing 200 is narrow, it is possible to effectively use the space to provide a mechanism for pushing the second crossbar 53*b* and a mechanism for controlling the operation of the operation coil switch 94.

Further, in the contactor 100 according to the embodiment, the first crossbar 53*a* made of an insulating resin is provided below the movable iron core 52 that is a conductor. Therefore, even when an arc generated between the contact points passes through the through hole 16*a* of the partition plate 16, the transmission of the arc to the movable iron core 52 is prevented by the first crossbar 53*a*. Further, by providing the first crossbar 53*a* below the movable iron core 52, the movable iron core 52 does not directly contact the protrusion 17*c* made of an insulating resin, which can reduce damage and wear of the protrusion 17*c*.

The configurations described in the above-mentioned embodiments indicate examples of the contents of the present invention. The configurations can be combined with another well-known technique, and some of the configurations can be omitted or changed in a range not departing from the gist of the present invention.

REFERENCE SIGNS LIST

1 power-side terminal; 2*a*, 2*b* screw; 3 power-side fixed contact; 3*a*, 9*a*, 82*a* one end; 3*b*, 9*b*, 82*b* other end; 4 power-side fixed contact point; 5 power-side movable contact point; 6 movable contact; 7 load-side movable contact point; 8 load-side fixed contact point; 9 load-side fixed contact; 11 load-side terminal; 15 lower case; 16, 17 partition plate; 16*a*, 17*b* through hole; 16*b* open wall surface; 17*a* plate surface; 17*c*, 83*b* protrusion; 18 upper case; 21 power-side grid; 22 load-side grid; 23 arc runner; 24 power-side grid fixer; 25 power-side grid fixer window; 26 load-side grid fixer; 27 load-side fixer window; 28 lower case power-side window; 29 lower case load-side window; 50 operation coil; 50*a*, 64*a* fixing member; 51 fixed iron core; 52 movable iron core; 53*a*, 53A first crossbar; 53*a*1 plate; 53*a*2 projection; 53*b*, 53B second crossbar; 53*b*1 body; 55 tripping spring; 56 push spring; 57, 58 operation coil terminal; 60 trip coil; 61 plunger; 62 plunger push spring; 63 link rod; 64, 81*a*, 84, 85*a*, 88*a*, 93, 95*a* pin; 65 insulating pipe; 70 iron core holding member; 80 manual control mechanism; 81 handle; 81*b*, 83*a* rotor; 81*c* operating portion; 82 opening lever; 82*c* end face; 83 magnetic bar; 85 latch; 86 lever; 87 U shaft; 88 upper link; 89 lower link; 90 arm; 91 arm pin; 92 arm link pin; 94 operation coil switch; 95 switch lever; 100, 100A contactor; 200 housing; 201, 202 space; 300 power-side outer conductor; 400 load-side outer conductor; 500 external power supply; 501, 502 wire.

The invention claimed is:

1. A contactor having a movable contact including a movable contact point and a fixed contact including a fixed contact point facing the movable contact point, the contactor comprising:

a fixed iron core;

a movable iron core, one end of the movable iron core facing the fixed iron core;

an operation coil provided around the movable iron core, the operation coil being configured to generate, by a current supplied from an outside of the contactor, an electromagnetic force that brings the movable iron core into contact with the fixed iron core;

a first movable bar having an insulating property, one end of the first movable bar being fixed to another end of the movable iron core;

a tripping spring to push the first movable bar in a direction away from the fixed iron core;

a second movable bar, one end of the second movable bar facing another end of the first movable bar, another end of the second movable bar holding the movable contact, the second movable bar being configured to move in a direction same as a moving direction of the first movable bar;

a push spring to push the movable contact toward the fixed contact;

a trip coil connected to the fixed contact;

a plunger to be operated by an electromagnetic force generated in the trip coil when a current of a predetermined value or higher flows through the trip coil; and two opening levers that directly contact the second movable bar to push the second movable bar in a direction away from the first movable bar as a result of an operation of the plunger.

2. The contactor according to claim 1, wherein the first movable bar includes:

a plate extending in a direction orthogonal to the moving direction of the first movable bar; and a projection provided on the plate and extending from the plate toward the second movable bar, a width of the projection in the direction orthogonal to the moving direction of the first movable bar being narrower than a width of the plate in the direction orthogonal to the moving direction of the first movable bar; and the two opening levers sandwich the projection.

3. The contactor according to claim 1, wherein the second movable bar includes:

a body extending in a direction orthogonal to the moving direction of the first movable bar; and a projection provided on the body and extending from the body toward the first movable bar, a width of the projection in the direction orthogonal to the moving direction of the first movable bar being narrower than a width of the body in the direction orthogonal to the moving direction of the first movable bar, and the two opening levers sandwich the projection.

4. The contactor according to claim 1, comprising:

an operation coil switch to supply current to the operation coil or stop supply of current to the operation coil; and a switch lever to turn on or off the operation coil switch in conjunction with the two opening levers.

5. The contactor according to claim 4, comprising an arm to rotate around a support shaft, wherein the two opening levers are provided on the arm at a position closer to the first movable bar, and the switch lever is provided on the arm at a position farther from the first movable bar.

6. The contactor according to claim 1, wherein assuming that L1 is a distance from the fixed contact point to the movable contact point obtained when the second movable bar is pushed down by the two opening levers, and L2 is a distance from the fixed contact point to the movable contact point obtained when the second movable bar is pushed down by the first movable bar, L1 is longer than L2.

7. The contactor according to claim 1, comprising:

a conductive arc runner facing the second movable bar across the movable contact; and a magnetic material grid facing the second movable bar across the movable contact point and the fixed contact point, wherein the fixed contact has a U-shaped cross section.

8. A contactor having a movable contact including a movable contact point and a fixed contact including a fixed contact point facing the movable contact point, the contactor comprising:

a fixed iron core;

a movable iron core, one end of the movable iron core facing the fixed iron core;

an operation coil provided around the movable iron core, the operation coil being configured to generate, by a current supplied from an outside of the contactor, an electromagnetic force that brings the movable iron core into contact with the fixed iron core;

a first movable bar having an insulating property, one end of the first movable bar being fixed to another end of the movable iron core;

a tripping spring to push the first movable bar in a direction away from the fixed iron core;

a second movable bar, one end of the second movable bar facing another end of the first movable bar, another end of the second movable bar holding the movable contact on an upper surface of the movable contact, the second movable bar being configured to move in a direction same as a moving direction of the first movable bar fixed on the movable iron core and a moving direction of the movable iron core;

a push spring to push the movable contact toward the fixed contact;

a trip coil connected to the fixed contact;

a plunger to be operated by an electromagnetic force generated in the trip coil when a current of a predetermined value or higher flows through the trip coil; and two opening levers to push the second movable bar in a direction away from the first movable bar as a result of an operation of the plunger.

9. The contactor according to claim 8, wherein the first movable bar includes:

a plate extending in a direction orthogonal to the moving direction of the first movable bar; and a projection provided on the plate and extending from the plate toward the second movable bar, a width of the projection in the direction orthogonal to the moving direction of the first movable bar being narrower than a width of the plate in the direction orthogonal to the moving direction of the first movable bar, and the two opening levers sandwich the projection.

10. The contactor according to claim 8, wherein the second movable bar includes:

a body extending in a direction orthogonal to the moving direction of the first movable bar; and a projection provided on the body and extending from the body toward the first movable bar, a width of the projection in the direction orthogonal to the moving direction of the first movable bar being narrower than a width of the body in the direction orthogonal to the moving direction of the first movable bar, and the two opening levers sandwich the projection.

11. The contactor according to claim 8, comprising:

an operation coil switch to supply current to the operation coil or stop supply of current to the operation coil; and a switch lever to turn on or off the operation coil switch in conjunction with the two opening levers.

12. The contactor according to claim 11, comprising an arm to rotate around a support shaft, wherein the two opening levers are provided on the arm at a position closer to the first movable bar, and the switch lever is provided on the arm at a position farther from the first movable bar.

13. The contactor according to claim 8, wherein

L1 is a distance from the fixed contact point to the movable contact point obtained when the second movable bar is pushed down by the two opening levers, L2 is a distance from the fixed contact point to the movable contact point obtained when the second movable bar is pushed down by the first movable bar, and L1 is longer than L2.

14. The contactor according to claim 8, comprising:

a conductive arc runner facing the second movable bar across the movable contact; and a magnetic material grid facing the second movable bar across the movable contact point and the fixed contact point, wherein the fixed contact has a U-shaped cross section.

* * * * *